US006811502B1

(12) United States Patent
Janes et al.

(10) Patent No.: US 6,811,502 B1
(45) Date of Patent: Nov. 2, 2004

(54) RACQUET WITH ELONGATED PERIPHERAL MAIN STRING SEGMENTS AND ENLARGED SWEET SPOT

(75) Inventors: Richard Janes, Worcester, MA (US); Po-Jen Cheng, Oak Brook, IL (US); William D. Severa, West Chicago, IL (US); Gerald J. LeVault, Addison, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 0 days.

(21) Appl. No.: 10/427,107

(22) Filed: Apr. 30, 2003

(51) Int. Cl.[7] ..... A63B 49/02; A63B 49/06

(52) U.S. Cl. ..... 473/546; 473/521; 473/524; 473/539; 473/540; 473/542; 473/543; 473/548

(58) Field of Search ..... 473/520, 521, 473/524, 534, 539, 540, 542, 543, 546, 548; D21/729

(56) References Cited

U.S. PATENT DOCUMENTS

| | | | | | |
|---|---|---|---|---|---|
| 2,089,118 | A | * | 8/1937 | Fritsch | 473/534 |
| 3,884,467 | A | | 5/1975 | Sommer | |
| 4,209,170 | A | * | 6/1980 | Garver | 473/546 |
| 4,220,335 | A | * | 9/1980 | Nobbs | 473/539 |
| 4,322,076 | A | * | 3/1982 | Bertram et al. | 473/537 |
| 4,333,650 | A | | 6/1982 | Soong | |
| 4,437,662 | A | | 3/1984 | Soong | |
| D286,902 | S | | 11/1986 | Tilley | |
| 4,690,405 | A | | 9/1987 | Frolow | |
| 4,988,101 | A | * | 1/1991 | Soong | 473/521 |
| 4,993,711 | A | | 2/1991 | Deville et al. | |
| 5,037,097 | A | | 8/1991 | Svoma et al. | |
| 5,133,552 | A | * | 7/1992 | Feeney et al. | 473/537 |
| 5,137,273 | A | | 8/1992 | Jseng | |
| 5,141,228 | A | * | 8/1992 | Soong | 473/521 |
| 5,197,731 | A | | 3/1993 | Svoma et al. | |
| 5,306,004 | A | * | 4/1994 | Soong | 473/522 |
| 5,551,689 | A | | 9/1996 | Svoma et al. | |
| 5,702,313 | A | * | 12/1997 | Stennett | 473/546 |
| 5,919,104 | A | | 7/1999 | Mortvedt et al. | |
| 6,027,420 | A | * | 2/2000 | Soong | 473/540 |
| 6,050,909 | A | | 4/2000 | Severa et al. | |
| 6,062,994 | A | | 5/2000 | Grimes et al. | |
| 6,319,158 | B1 | * | 11/2001 | Cheng | 473/522 |
| 6,432,005 | B1 | | 8/2002 | Lin | |
| 6,500,080 | B2 | * | 12/2002 | Severa et al. | 473/521 |
| 6,527,656 | B1 | | 3/2003 | Cheng et al. | |
| 6,537,165 | B1 | * | 3/2003 | Mockenhaupt et al. | 473/521 |
| 6,663,516 | B2 | * | 12/2003 | Severa et al. | 473/521 |
| 2002/0165050 | A1 | * | 11/2002 | Severa et al. | 473/524 |
| 2003/0036448 | A1 | * | 2/2003 | Severa et al. | 473/521 |

FOREIGN PATENT DOCUMENTS

| | | | | |
|---|---|---|---|---|
| DE | 4115502 | * | 11/1992 | 473/FOR 171 |
| EP | 0 727 244 A | | 8/1996 | |
| GB | 2056288 | * | 3/1981 | |
| GB | 2226250 | * | 6/1990 | |

OTHER PUBLICATIONS

Sikowitz, Peter, "The String Is The Thing", "World Tennis" Magazine, p. 48, Mar. 1986.*

* cited by examiner

*Primary Examiner*—Raleigh W. Chiu
(74) *Attorney, Agent, or Firm*—Terence P. O'Brien

(57) ABSTRACT

A sports racquet including a frame, a yoke and a string bed. The frame includes a head portion, a handle portion, and a throat portion positioned between the head and handle portions. The head portion includes an upper region, and first and second side regions. The yoke is coupled to the first and second side regions. The head portion and the yoke define a string bed area. The string bed is formed of a number of cross and main string segments. The main string segments include at least one central main string segment and at least two peripheral main string segments. Each central main string segment has first and second ends wherein the first end engages the head portion and the second end engages the yoke. Each peripheral main string segment is coupled at a proximal end to at least one of the throat portion and the handle portion.

47 Claims, 16 Drawing Sheets

H1 ES Racquet 1

H1 NON-ES Racquet 1

Fig 16 Prior Art Racquet 1
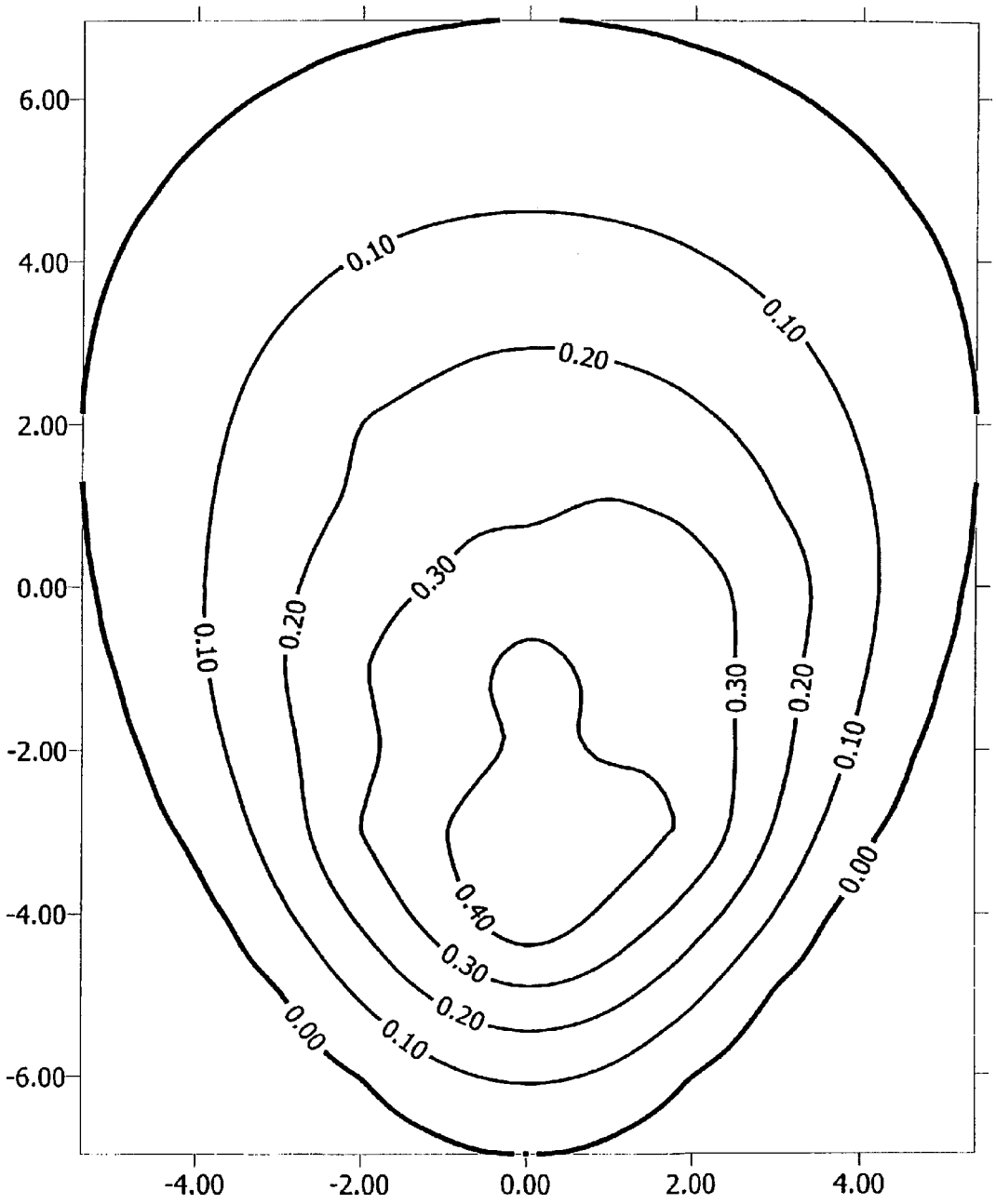

RACQUET WITH ELONGATED PERIPHERAL MAIN STRING SEGMENTS AND ENLARGED SWEET SPOT

FIELD OF THE INVENTION

The present invention relates generally to a sports racquet. In particular, the present invention relates to racquet including a string bed with elongated peripheral main string segments providing an enlarged sweet spot.

BACKGROUND OF THE INVENTION

Sport racquets, such as tennis, racquetball, squash and badminton racquets, are well known and typically include a frame having a head portion coupled to a handle portion. The head portion supports a string bed having a plurality of main string segments interwoven with a plurality of cross string segments. Many racquets also include a throat portion positioned between and connecting the handle portion to the head portion. The typical string bed of a sports racquet includes a central region, that provides the most responsiveness, the greatest power and the best "feel" to the player, upon impact with a ball, and a peripheral region. The central region, commonly referred to as the "sweet spot," is typically defined as the area of the string bed that produces higher coefficient of restitution ("COR") values. A higher COR generally directly corresponds to greater power and greater responsiveness.

The peripheral region is the region between the sweet spot and the hoop of the head portion of the racquet. The peripheral region provides increasingly reduced levels of responsiveness power and feel to the player the further away the location of impact occurs from the sweet spot. As a result, a typical racquet provides a wide variety of responsiveness and power depending upon the location of the impact. In many racquets, a mis-hit, occurring just a small distance away from the sweet spot, can produce an undesired response from the racquet. The significant variability in a string bed's power and responsiveness between the sweet spot and locations about the peripheral region can result in inconsistent play if the player does not consistently impact the ball at the sweet spot. The variability of the string bed response can also reduce the margin of error afforded to the player upon impact with a ball, which can contribute to unforced errors.

Some existing racquets incorporate a larger sized hoop portion supporting a larger sized string bed (i.e., a larger head size) in an effort to increase the size of the string bed and the sweet spot. However, as the head size of a racquet increases so does the polar moment of inertia of the racquet. A racquet with a higher polar moment of inertia can be more difficult to maneuver, particularly at the net or upon return of serve, than a racquet with a lower moment of inertia. Additionally, some users find a large head racquets to be more difficult to swing than racquets with normal sized heads.

Other existing racquets extend the length of the central most main string segments in order to increase the size of the racquet's sweet spot. However, the central main string segments of a typical string bed are generally already of sufficient length to provide the desired response at the central most portions of the string. Further increasing the length of the already elongated central main string segments can produce too much variability in the string bed performance and potentially lead to a string bed with undesirable variability in response and performance.

Thus, there is a continuing need for a racquet having a string bed with an enlarged sweet spot, which does not negatively effect the overall performance of the racquet. It would be advantageous to produce a racquet with a string bed that provides a high level of response and power over a larger area, without producing excessive or undesirable variability in response or performance across the string bed. What is needed is a racquet that can increase the performance of the racquet at the peripheral regions of the string bed and generally enlarge the sweet spot of the racquet. It would be advantageous to provide a racquet with an enlarged sweet spot without increasing the polar moment of inertia of the racquet head and without negatively affecting the maneuverability of the racquet. There is also a need for a racquet having a string bed with an enlarged sweet spot that is not a radical departure in look and design from traditional sport racquet designs.

There also exists a continuing need for innovative approaches to efficiently and reliably securing elongated racquet string(s) to a racquet. In particular, it would be advantageous to provide a racquet that allows for elongated main string segments to be coupled or engaged to the throat or handle of the racquet without producing unnecessary stress risers in the racquet frame, and without providing restricted or rough string passages. It would be desirable to produce a lightweight durable article for facilitating the passage of racquet string through the racquet frame, and a method of making such an article, that can be incorporated into a composite racquet in a reliable and cost efficient manner. It would be advantageous if such a method were applicable to other composite sporting goods such as, for example, ball bats and golf shafts.

SUMMARY OF THE INVENTION

The present invention provides a sports racquet including a frame, a yoke and a string bed. The frame includes a head portion, a handle portion, and a throat portion positioned between the head and handle portions. The head portion includes an upper region, and first and second side regions. The yoke is coupled to, and extending between, the first and second side regions. The head portion and the yoke define a string bed area. The string bed is formed of a plurality of cross string segments and a plurality of main string segments. The main string segments include at least one central main string segment and at least two peripheral main string segments. Each central main string segment has first and second ends wherein the first end engages the upper region of the head portion and the second end engages the yoke without engaging either the throat portion or the handle portion. Each of the peripheral main string segments extends, across the string bed area, through the yoke, and into the throat portion. Each peripheral main string segment is coupled at a distal end to the upper region of the head portion and at a proximal end to at least one of the throat portion and the handle portion.

According to a principal aspect of the invention, a sports racquet configured to support a string bed formed by a plurality of transversely extending cross string segments and a plurality of longitudinally extending central main string segments and a plurality of longitudinally extending peripheral main string segments, wherein each of the central and peripheral main string segments have a distal end and a proximal end includes a frame, a yoke and at least one peripheral main string support mechanism. The frame includes a head portion, a handle portion, and a throat portion positioned between the head and handle portions. The head portion includes an upper region, and first and second side regions. The yoke is coupled to, and extends between, the first and second side regions. The head portion and the yoke define a string bed area. The yoke include a central section and first and second side sections. The central section is configured for engaging the proximal end of at least one central main string segment, and the first and second side sections is configured to allow for at least one peripheral main string segment to extend through the yoke. The main string support mechanism is included in the throat portion or the handle portion. The peripheral main string support mechanism is configured to engage the proximal end of the at least one peripheral main string segments.

According to another principal aspect of the invention, a sports racquet includes a frame and a string bed. The frame includes a head portion, a handle portion, and a throat portion positioned between the head and handle portions. The string bed is coupled to the frame and is formed of a plurality of cross and main string segments. The main string segments include at least two central main string segments and at least two peripheral main string segments. The length of each of the peripheral main string segments is greater than the length of each of the central main string segments.

According to another principal aspect of the invention, a sports racquet includes a frame, a yoke, at least two central main string segments, and at least two peripheral main string segments. The frame extends along a longitudinal axis and includes a head portion, a handle portion, and a throat portion positioned between the head and handle portions. The head portion includes first and second side regions. The yoke is coupled to, and extends between, the first and second side regions. The central main string segments include at least one central-most main string segment having a first length. The central-most main string segment is positioned at, or adjacent to, the longitudinal axis. The peripheral main string segments include at least one outermost peripheral main string segment. The outermost peripheral main string segment has a second length. The outermost peripheral main string segment is spaced apart from the longitudinal axis and is positioned adjacent to one of the first and second side regions of the head portion. The second length is at least 75 percent of the first length.

According to another principal aspect of the invention, a method of producing a sporting goods article includes obtaining a mandrel and positioning plural composite layers adjacent each other over the mandrel to form a first portion of the sporting goods article. The method also includes obtaining a first structural element formed of a thermoplastic material, the thermoplastic material having a melting point greater than 325 degrees F., and positioning the first structural element in a predetermined position adjacent to the first portion. The method further includes applying at least one additional composite layer over at least a portion of one of the first portion and the first structural element, and curing the first portion, and the at least one additional composite layer.

This invention will become more fully understood from the following detailed description, taken in conjunction with the accompanying drawings described herein below, and wherein like reference numerals refer to like parts.

BRIEF DESCRIPTION OF THE DRAWINGS

FIG. 16 is a two dimensional mapping of the coefficients of restitution on the string bed of a representative prior art racquet.

DETAILED DESCRIPTION OF THE PREFERRED EMBODIMENTS

Figure 1:
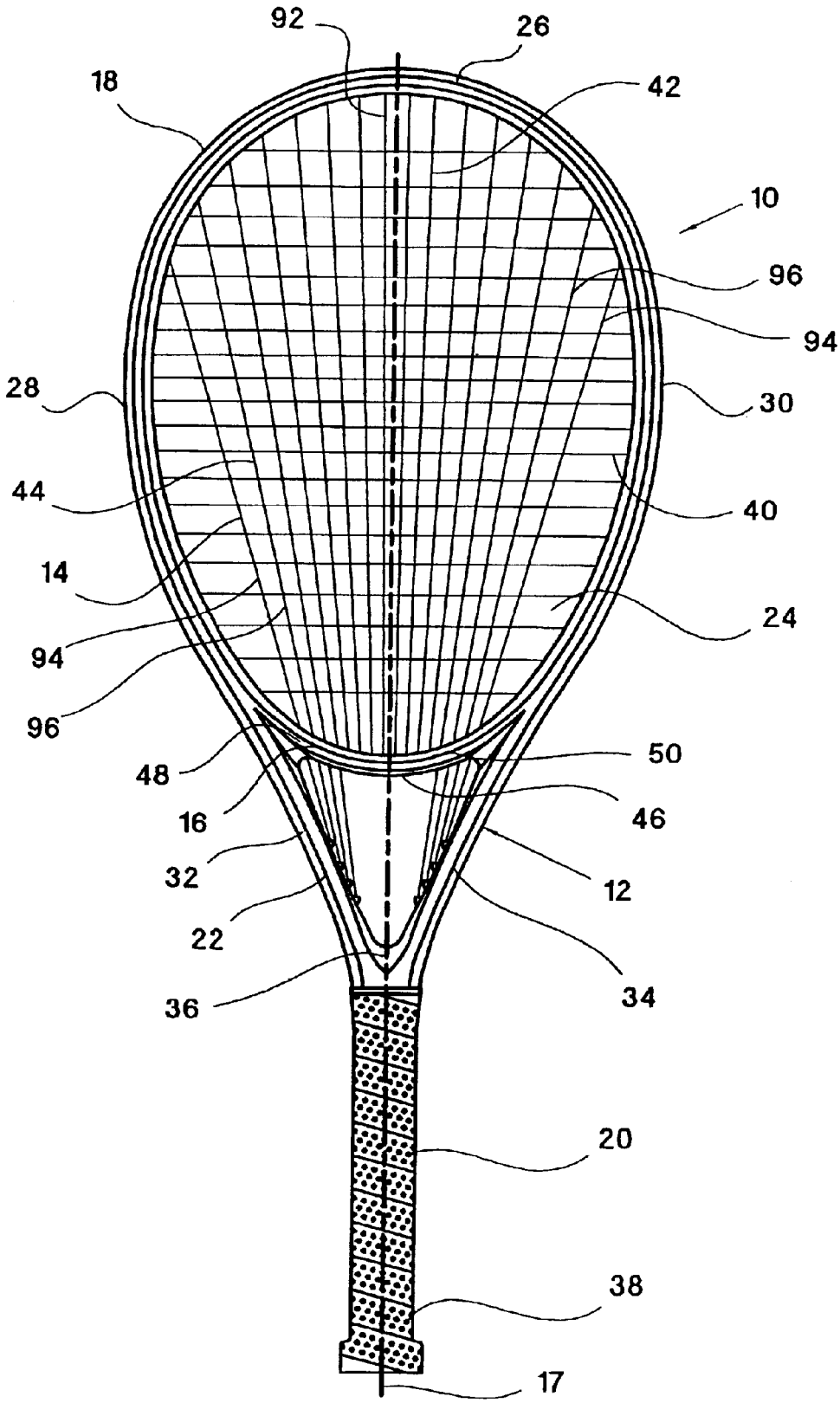
FIG. 1 is a front view of a racquet in accordance with a preferred embodiment of the present invention.

Referring to FIG. 1, a sports racquet is indicated generally at 10. The racquet 10 of FIG. 1 is configured as a tennis racquet, however, the invention can also be formed as other types of sports racquets, such as, for example, a racquetball racquet, a squash racquet, or a badminton racquet. The racquet 10 includes a frame 12, a string bed 14 and a yoke 16. The frame 12 is a tubular structure having a longitudinal axis 17 and including a head portion 18, a handle portion 20, and a throat portion 22 coupling the head and handle portions 18 and 20. The frame 12 is formed of a lightweight, durable material, preferably a carbon-fiber composite material. Alternatively, the frame 12 can be formed of other materials including metallic alloys, other composite materials, or combinations thereof. The head portion 18 forms an upper region 26 and first and second side regions 28 and 30, and together with the yoke 16 defines a string bed area 24 for receiving and supporting the string bed 14.

In a preferred embodiment, the first and second side regions 28 and 30 downwardly extend from the head portion 18 to form first and second throat tubes 32 and 34 of the throat portion 22, which converge at a crotch region 36 of the throat portion 22. The converged first and second throat tubes 32 and 34 then further downwardly extend to form the handle portion 20. The handle portion 20 includes a pallet (not shown) and a grip 38. In alternative preferred embodiments, the handle portion 20 can be a tubular structure that is formed separately from either the throat portion or the head portion of the frame and is attached to the throat portion through use of conventional fasteners, adhesives or combinations thereof.

In another preferred embodiment, the head portion 18 is directly connected to one or both of the throat portion 22 and the yoke 16 through the use of conventional fastener, adhesives, mechanical bonding, thermal bonding, or other combinations thereof. Alternatively, the head portion 18 can be separated from one or both of the throat portion and the yoke by a vibration and shock absorbing material, such as an elastomer. In yet another alternative preferred embodiment, the head portion 18 is integrally formed with one or both of the throat portion 22 and the yoke 16.

The string bed 14 is formed by a plurality of main string segments interwoven with a plurality of cross string segments 40. The main and cross string segments can be formed from one continuous piece of racquet string, or from two or more pieces of racquet string. The cross string segments 40 and most of the main string segments are engaged with the head portion 18 of the frame, preferably by extending through string holes (not shown) within the head portion 18. Alternatively, the string segments can be wrapped around or otherwise secured to the head portion through fasteners or other conventional means. The cross string segments 38 generally transversely extend from the first side region 26 across the string bed area 24 to the second side region 28.

The main string segments extend from the upper region 26 and the upper ends of the first and second side regions 28 and 30 of the head portion 18 generally downward across the string bed area 24 toward the yoke 16. The main string segments include at least one central main string segment(s) 42 and a plurality of peripheral main string segments 44. The central main string segments 42 are positioned at or near the centrally positioned longitudinal axis 17 of the racquet 10. The number of central main string segments 42 in a racquet 10 of the present invention can vary from one to a value equivalent to two less than the total number of main string segments. In a particularly preferred embodiment (FIG. 1), the racquet 10 includes eight central main string segments 42.

The peripheral main string segments 44 are spaced away from the longitudinal axis 17, and are positioned on each side of the group of one or more central main string segments 42. The number of peripheral main string segments 44 in a racquet can vary from one on each side of the group of central main string segments (for a total of two) to a value equivalent to one less than the total number of main string segments. In the particularly preferred embodiment of FIG. 1, the racquet 10 includes four peripheral main string segments 44 on each side of the group of central main string segments 42 for a total of eight peripheral main string segments 44. In one preferred embodiment, the central and peripheral main string segments 42 and 44 extend generally parallel with the longitudinal axis 17 across the string bed area 24. In another alternative preferred embodiment, the central and peripheral main string segments 42 and 44 longitudinally extend along the string bed area 24 in a "fanned" or "flared" configuration, wherein the central most main string segments are generally parallel with the longitudinal axis 17 and the angle of the remaining main string segments increases slightly with respect to the longitudinal axis 17 the further the main string segments are from the longitudinal axis 17.

Figure 2:
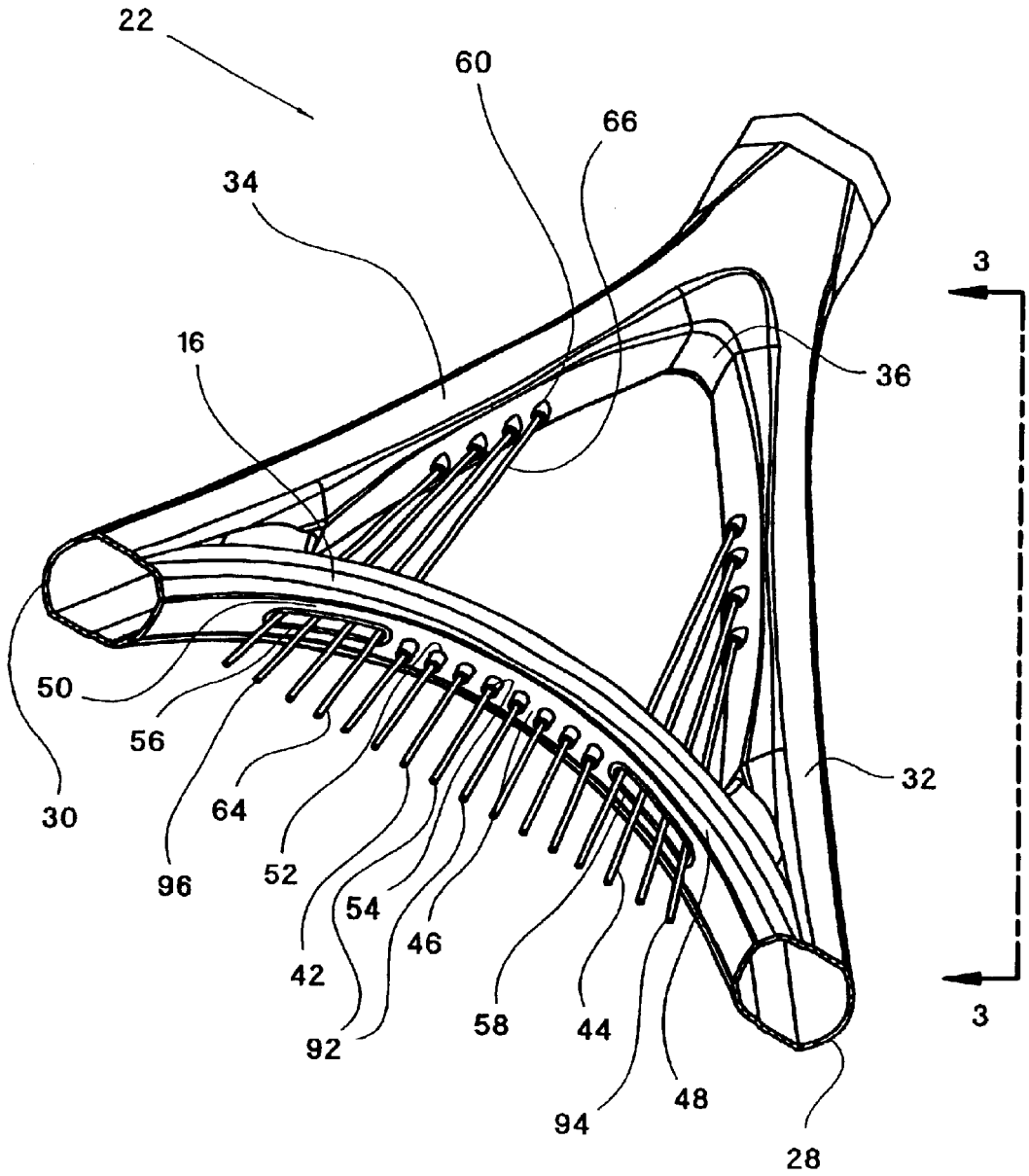
FIG. 2 is a front perspective sectional view of a yoke and a throat portion of the racquet of FIG. 1.

Referring to FIGS. 1 and 2, the yoke 16 is an elongate tubular structural member which extends from the first side region 28 to the second side region 30 of the head portion 18. In one preferred embodiment, the yoke 16 is integrally formed with the frame 12. In alternative preferred embodiments, the yoke 16 can be connected through use of adhesives, fasteners, bonding and combinations thereof. In another embodiment, the yoke 16 can separated from the frame 12 by vibration absorbing material, such as, for example, an elastomer. The yoke 16 is formed of a lightweight, durable material, preferably a carbon-fiber composite material. Alternatively, the yoke 16 can be formed of other materials, such as, for example, metallic alloys, other composite materials, and combinations thereof. The yoke 16 provides structural support to the frame 12, as well as a means for defining the lower portion of the string bed area 24 and a support for engaging, routing or directing the main string segments.

The yoke 16 includes a central section 46 positioned between first and second side sections 48 and 50. In a preferred embodiment, the central section 46 of the yoke 16 includes two or more central main string holes 52 for receiving and engaging the central main string segments 42. A set of grommets 54 are preferably inserted into the central main string holes to protect the central main string segments 42 from direct contact with the yoke 16 as the string segment extends through the main string holes 52. The central main string segments 42 engage the central section 46 of the yoke 16 and generally do not extend beyond the yoke 16 to engage either the throat portion 22 or the handle portion 20.

Each of the first and second side sections 48 and 50 of the yoke 16 preferably include a slot 56 configured to receive at least one peripheral main string segment 44. The slot 56 is configured to enable one or more of the peripheral main string segments 44 to pass or extend through the yoke 16 for engagement with one or both of the throat portion 22 or the handle portion 20. Each slot 56 preferably has a thickness, measured in a direction substantially perpendicular to a plane defined by the string bed 14, which is at least equivalent to the diameter of the peripheral main string segment 44. In a particularly preferred embodiment, each slot 56 has a thickness that is at least three times the diameter of the peripheral main string segment 44. Each slot 56 preferably includes a protective tubular lining 58 for inhibiting direct contact between the peripheral main string segments and the yoke 16. The lining 58 and the grommets 54 are formed of a resilient material, preferably a nylon. In alternative preferred embodiments, the lining 58 and the grommets 54 can be made of other materials, such as, for example, natural rubber, synthetic rubber, silicon, a urethane, other polymeric materials or combinations thereof.

In an alternative preferred embodiments, the yoke 16 can be configured with other combinations, and other numbers of string holes and string slots. For example, in one preferred embodiment, the yoke 16 can be formed with a single slot configured to receive one or more inserts, wherein the insert(s) includes string holes and/or string slots. In another example, the yoke can be formed with three slots, one central slot for receiving the main string segments and the remaining two slots positioned on opposite sides of the central slot for receiving the peripheral main string segments. The central slot can then be configured to receive one or more inserts, wherein the insert(s) include string holes and/or string slots for engaging the central main string segments. In another alternative preferred embodiment, the central section 46 of the yoke 16 can be formed without main string holes.

Figure 3:
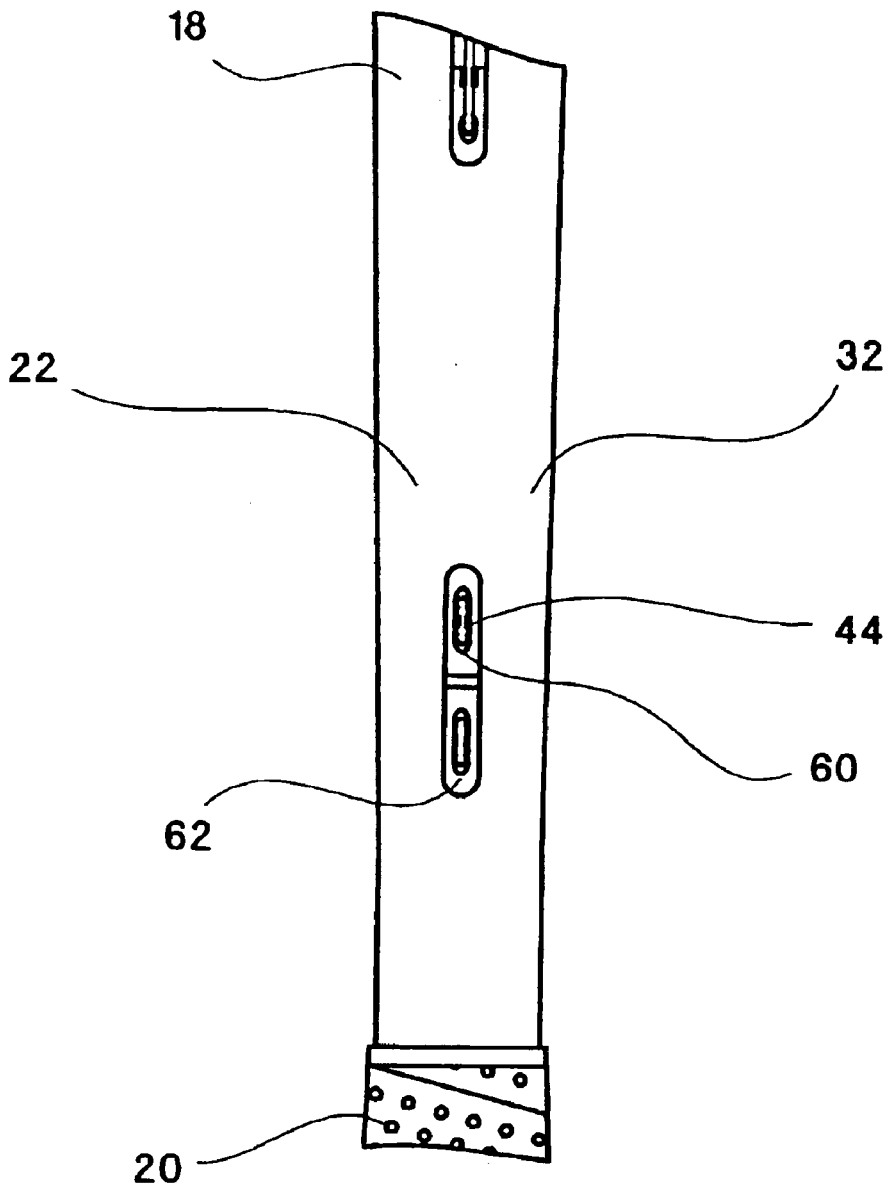
FIG. 3 is a side view of the throat portion of the racquet as viewed from line 3—3 of FIG. 2.

Referring to FIGS. 2 and 3, in one preferred embodiment, the first and second throat tubes 32 and 34 include throat string holes 60 for engaging the peripheral main string segments 44. Each set of the throat string holes 60 also preferably include grommets 52. The throat string holes 60 are aligned generally coplanar with the string bed 14. Each peripheral main string segment 44 extends through the string slot 56 of the yoke 16 and engages either the first or the second throat tube 32 and 34 at the string holes 60. In particular, the racquet string forms one peripheral main string segment 44 which extends from the head portion 18 through the yoke 16 toward and through one of the throat tubes 32 or 34. The racquet string then extends over the outer surface of the throat tube 32 or 34 to an adjacent string hole 60, where it passes through the throat tube back toward the yoke 16 and the head portion 18 to form another peripheral main string segment 44. A grommet strip 62 preferably is used to connect the grommets 54 of two or more adjacent string holes 60. In a particularly preferred embodiment, each of the throat tubes 32 and 34 includes four sets of string holes 60 for receiving and engaging four peripheral main string segments 44. In alternative preferred embodiments, other numbers of peripheral main string segments 44 and corresponding string holes 60 within the throat tubes can be used. In an alternative preferred embodiment, one or more of the peripheral main string segments 44 can engage and terminate at one of the throat tubes 32 and 34 without wrapping around and extending through an adjacent set of string holes. In another alternative preferred embodiments, the peripheral main string segments can engage the throat tubes through means other than the string holes, such as, for example, wrapping around the outer surface of the throat tube.

Each of the peripheral main string segments 44 includes a string bed piece 64 and a throat region piece 66, which are each generally coplanar with the string bed 14. In a particular preferred embodiment, the string bed piece 64 and throat region piece 66 of each peripheral main string segment are generally collinear. Alternatively, the string holes 60 can be positioned along the throat tubes such that the throat region piece 66 of the peripheral main string segment 44 is angled with respect to the string bed piece 64, and/or with respect to, one or more of the peripheral main string segment(s) 44.

Figure 4:
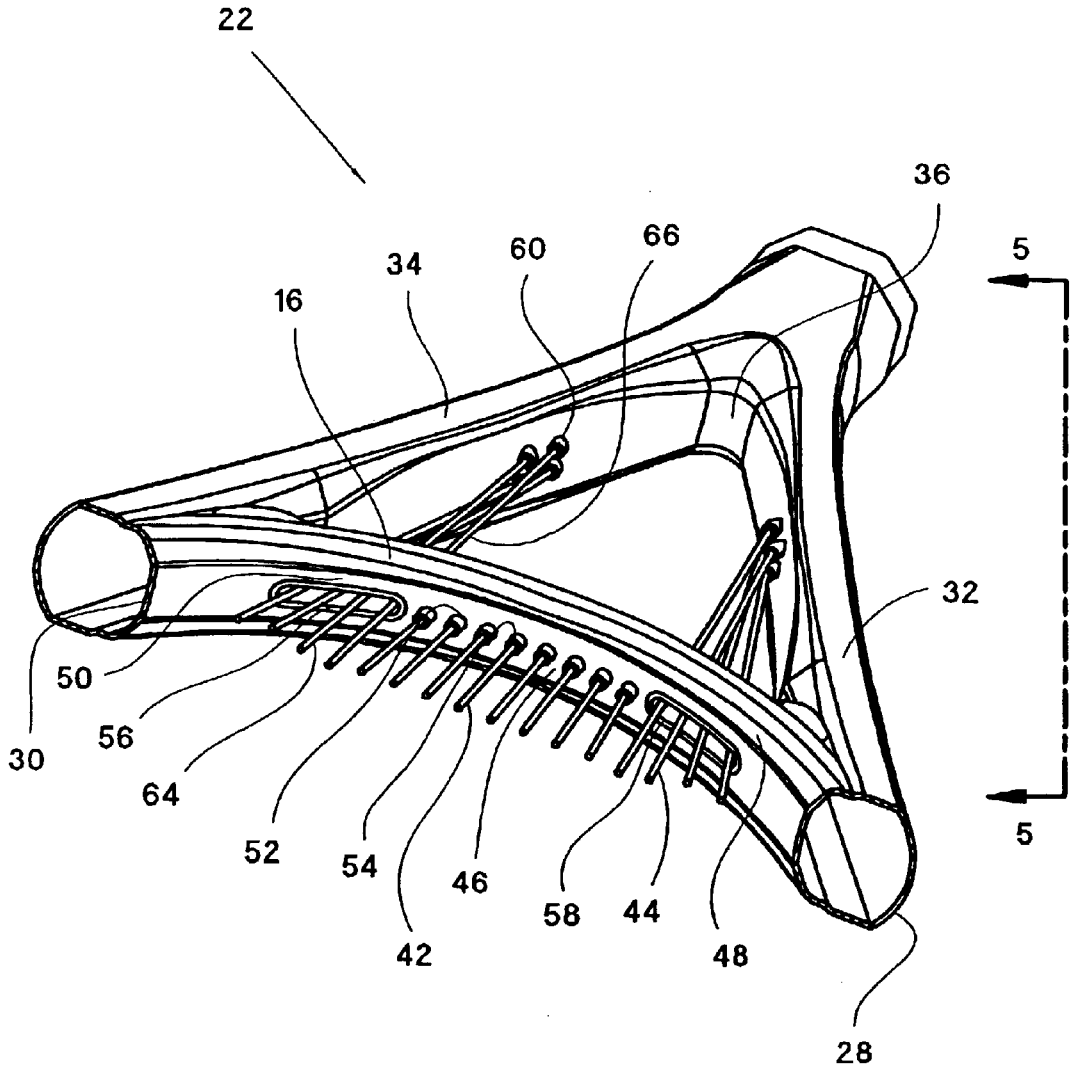
FIG. 4 is a front perspective sectional view of a yoke and a throat portion of a racquet in accordance with an alternative preferred embodiment of the present invention.
Figure 5:
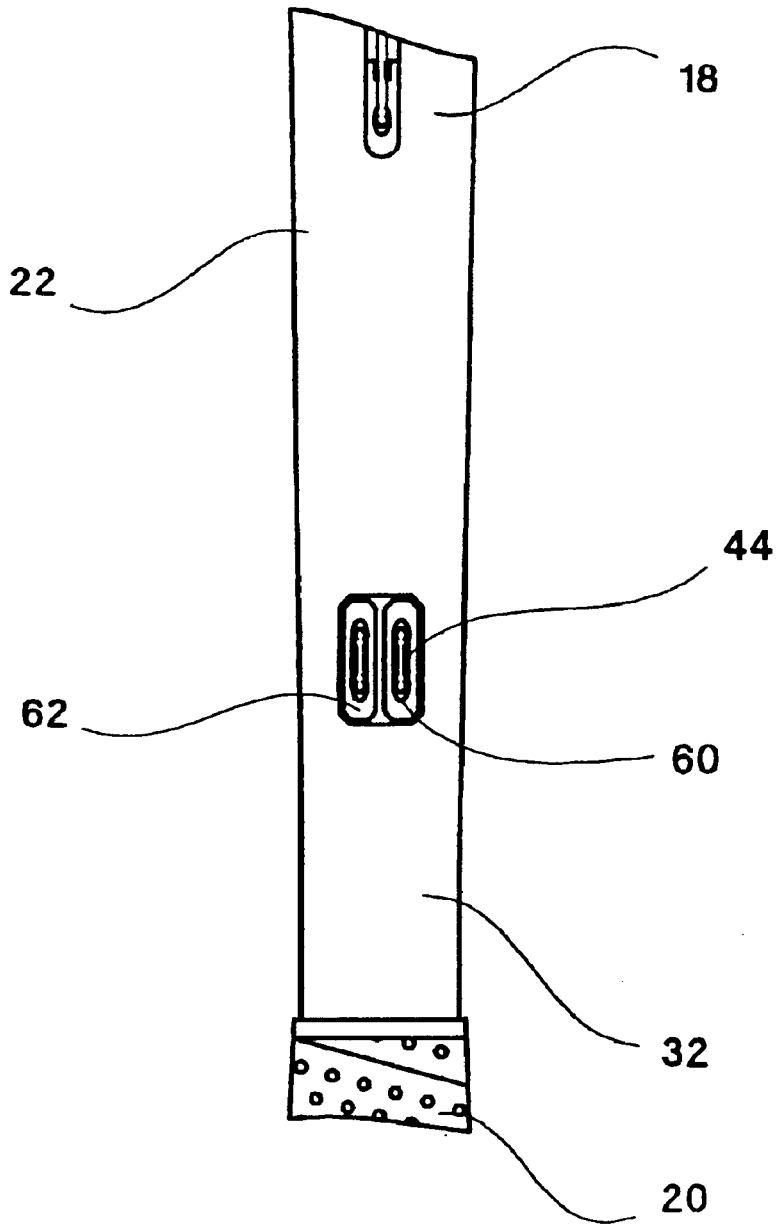
FIG. 5 is a side view of the throat portion of the racquet as viewed from line 5—5 of FIG. 4.

Referring to FIGS. 4 and 5, in another alternative preferred embodiment the string holes 60 in the first and second throat tubes 32 and 34 can be arranged in pairs which are generally symmetrically spaced apart from the plane defined by the string bed 14. The spaced apart pairing configuration of string holes 60 enables the string holes 60 to be positioned further down on the throat tubes 32 and 34 toward the handle portion 20 thereby enabling the length of the peripheral main string segments 44 to be increased. In alternative preferred embodiments, additional pairs of string bed holes can be added to each of the throat tubes. For example, a third pair of string holes could be positioned between the existing spaced apart pairs of string holes, generally along the string bed plane. Alternatively, additional sets of spaced apart pairs can be arranged in an end to end configuration thereby combining the "in series" string hole configuration of FIG. 3 with the "parallel" string hole configuration of FIG. 5. In yet another alternative preferred embodiment, each of the throat tubes can include a channel for receiving one or more throat inserts, wherein the throat insert includes string holes for engaging the peripheral main string segments.

Figure 6:
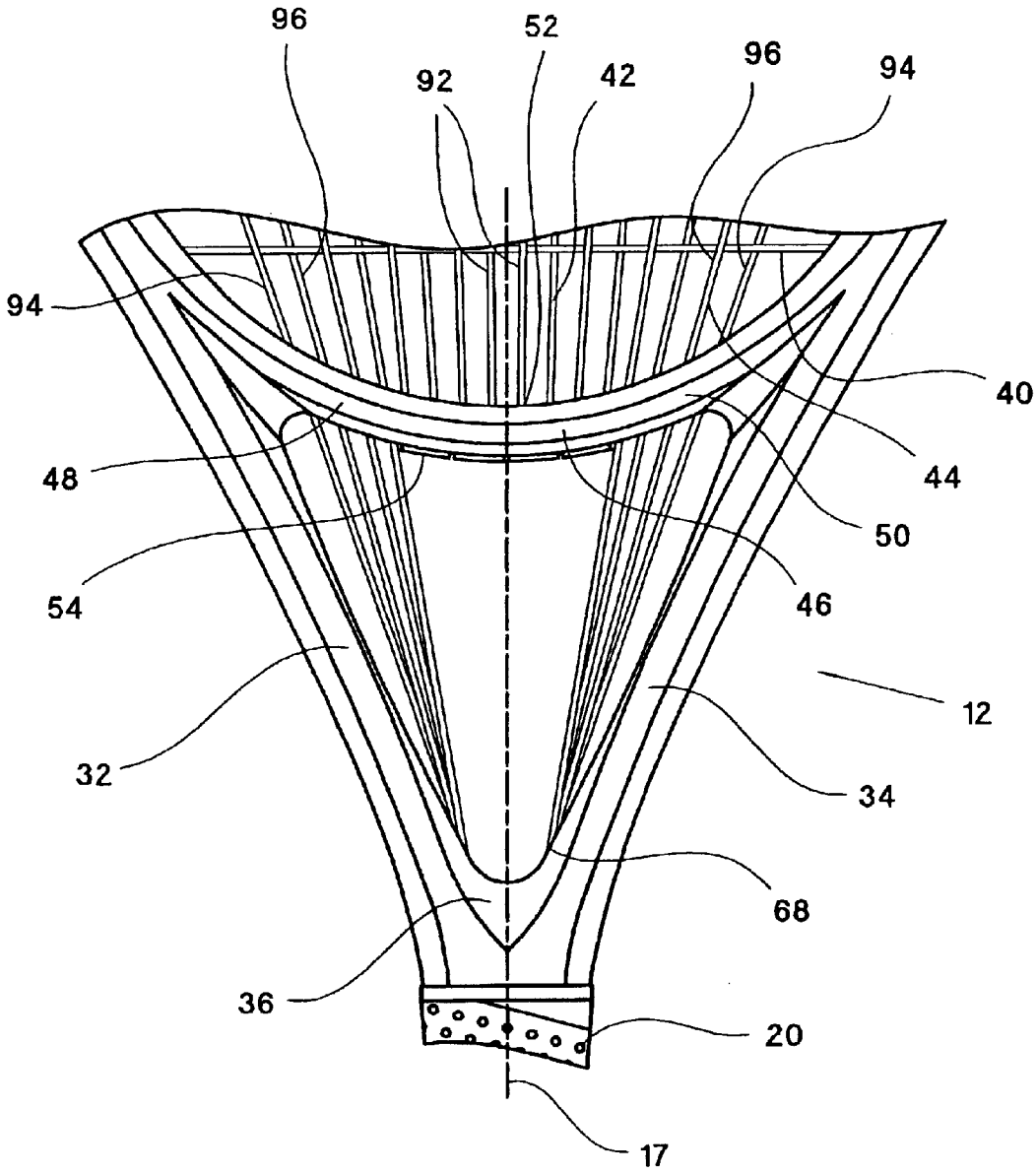
FIG. 6 is a front sectional view of a racquet in accordance with another alternative preferred embodiment of the present invention.
Figure 7:
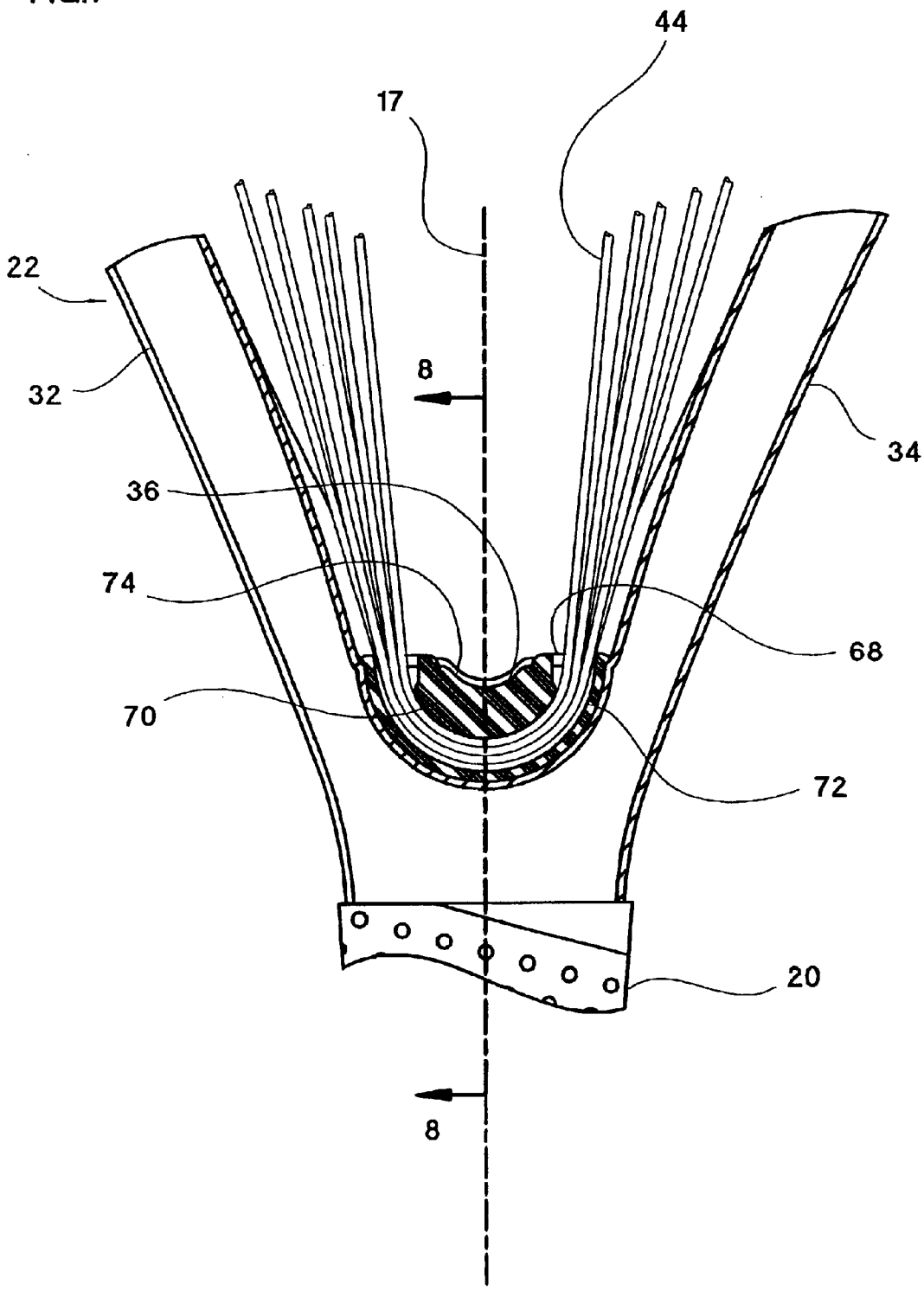
FIG. 7 is a longitudinal cross-sectional view of a throat portion of the racquet of FIG. 6 taken along a plane generally defined by the string bed of the racquet.

Referring to FIGS. 6 and 7, in another alternative preferred embodiment, the crotch region 36 of the throat portion 22 includes at least two openings 68. The peripheral main string segments 44 extend through the yoke 16 and engage the crotch region 36 of the throat portion 20, thereby maximizing the length of the peripheral main string segments 44.

Figure 8:
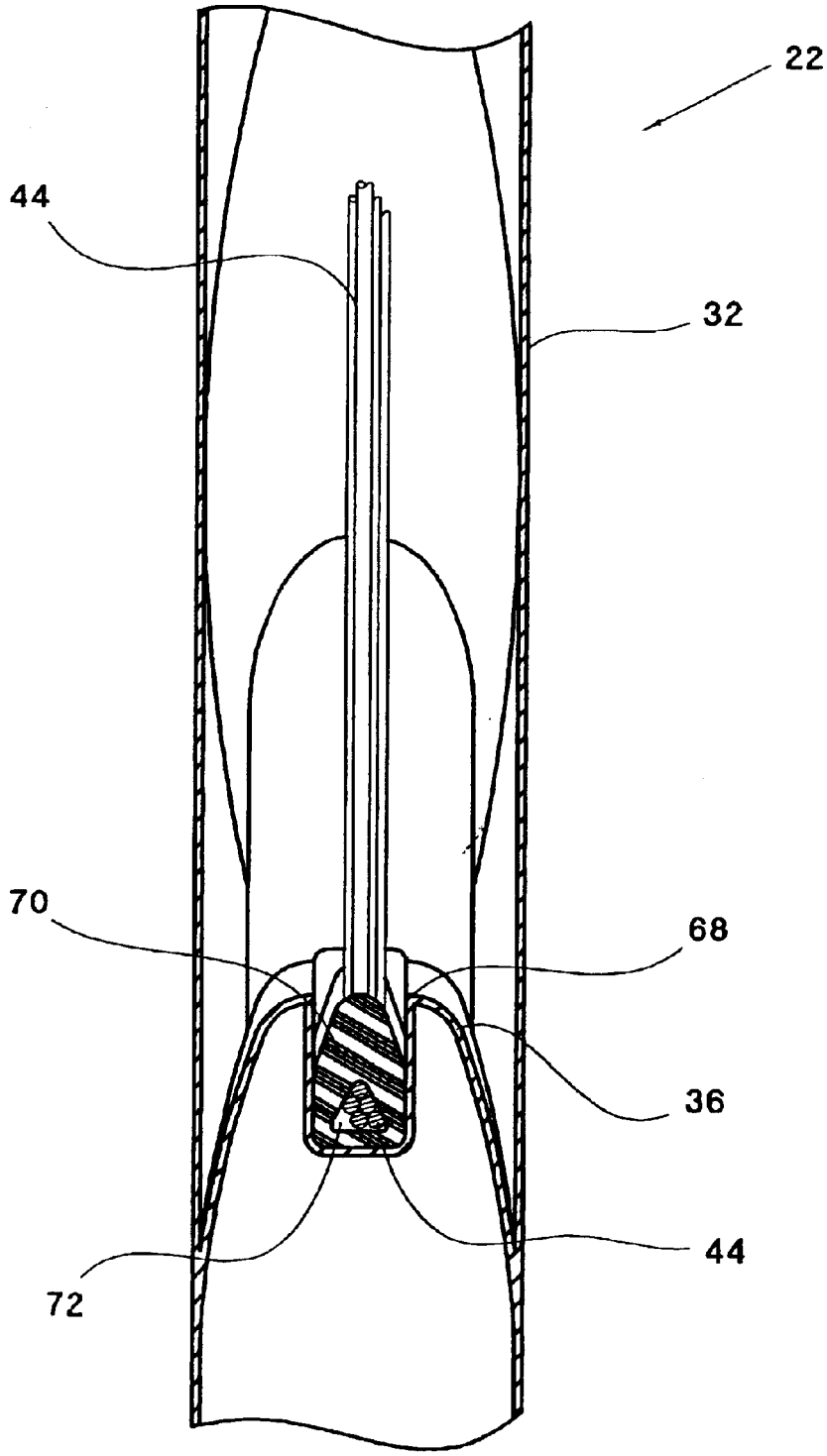
FIG. 8 is a longitudinal cross-sectional view of the throat portion taken along line 8—8 of FIG. 7.

Referring to FIGS. 7 and 8, the crotch region 36 of the throat portion 22 includes at least one bearing, and, in particular, a tubular housing 70. The housing 70 defines a string passage 72 opened at each end for receiving and guiding the racquet string. In particular, at least one main string segment 44 can extend through one of the openings 68 of the crotch region 36 into and through the passage 72 of the housing 70, and then out the other opening 68 to form another main string segment 44. Each section of the racquet string extending through the passage 72 and connecting the two peripheral main string segments 44 is referred to as a main string transition piece 45. In a particularly preferred embodiment, the housing 70 defines a generally U-shaped passage. Alternatively, other string passages of other shapes can be used, such as, for example, V-shaped or irregularly shaped. The string passage 70 is sized to receive at least one main string transition piece 45 and, preferably, multiple main string transition pieces 45. The housing 70 is made of a durable, lightweight, wear-resistant material, preferably a thermoplastic material. Alternatively, the housing 70 can be formed of other materials, such as, for example, a nylon. The housing 70 also facilitates stringing of the racquet 10 by enabling the individual stringing the racquet to easily route or "fish" the racquet string segment into one opening 68 through the string passage 72 and out the other opening to form another peripheral main string segment. The housing 70 further provides a smooth bearing surface for supporting the main string transition pieces 45, which inhibits string wear and protects the racquet string from contact with sharp edges of the frame 12. The housing 70 also provides a minimum bend radius thereby reducing the bending stresses applied to the racquet string extending through the passage 72.

Referring to FIG. 8, in a particularly preferred embodiment, the string passage 72 can have a generally triangularly shaped cross-sectional area, which facilitates the alignment of multiple main string transition pieces 45 extending through the passage 72. Alternatively, other cross-sectional shapes can also be used, such as, for example, an inverted triangular shape, an oval shape, a circular shape, other polygonal shapes, and a shape including multiple channels for receiving string segments. In an alternative preferred embodiment, the housing 70 can be attached to the handle portion 20 of the racquet 10.

The housing 70 is produced with the frame 12 in accordance with a preferred method of producing a sporting goods article. The method can also be used to produce at least a portion of other sporting goods articles, such as, for example, ball bats and golf shafts. The method includes the steps of obtaining a mandrel, positioning multiple layers of composite material, one at a time, over the mandrel to form a first portion of the article. The method further includes obtaining a first structural element, such as, for example, the housing 70. The structural element preferably is formed of a material having a melting point greater than 325 degrees F. The method further includes positioning the first structural element in a predetermined position adjacent the first portion. In a particularly preferred embodiment, the first structural element is the tubular housing 70, which is positioned in the crotch region 36 of the throat portion 22 of the racquet 10. The method then provides for applying at least one additional composite layer over at least part of the first portion of the article and the first structural element, and curing the first portion and the at least one additional composite layer to form the article. The article is preferably cured at approximately 325 degrees F. for approximately 15 minutes. Alternative curing temperatures and curing durations may be employed depending upon the number, size and configuration of the layers.

Referring to FIG. 7, in a particularly preferred embodiment, the at least one additional composite layer is an upper crotch wall 74 of the crotch region 36 of the throat portion 22. The crotch wall 74 retains the housing 70 within the crotch region 36 and provides for the string openings 68.

Each composite layer includes structural material arranged in a matrix. The structural material may be a series of fibers generally aligned adjacent to each other within each layer, and preferably, are positioned generally at a predetermined angle. The thickness of the layers and the orientation of the fibers can vary from one layer to the next. The composite layers are preferably applied about the mandrel such that the fibers lie in a variety of different angles. The structural fibers are formed of high strength material such as carbon. Alternatively, the fibers can be formed of other materials, such as, for example, aramid and fiberglass.

The preferred method enables the structural element, such as the housing 70, to be added to the article, such as the frame 12, during the lay-up or manufacturing stage of the composite article before curing, thereby eliminating the need for forming an opening within, or partially disassembling, the article in order to install the structural element. The preferred method enables the structural element to be formed within the composite article providing a reliable, secure connection with the article. Other methods of producing and assembling the housing 70 with the racquet 10 can also be employed.

In another alternative embodiment, the racquet 10 can include the crotch region 36 of the throat portion 22 having the spaced apart string openings 68 without a separate housing for directing the peripheral main string segments through the throat portion 22 and into and out of the string openings 68 of the crotch region 36. In such an embodiment, the throat region 22 can be configured and/or structured to enable the racquet string from a peripheral main string segment 44 to pass through a first string opening 68 route through the throat portion 22 of the racquet and extend out of the adjacent spaced apart string opening 68 to form another peripheral main string segment.

Figure 9:
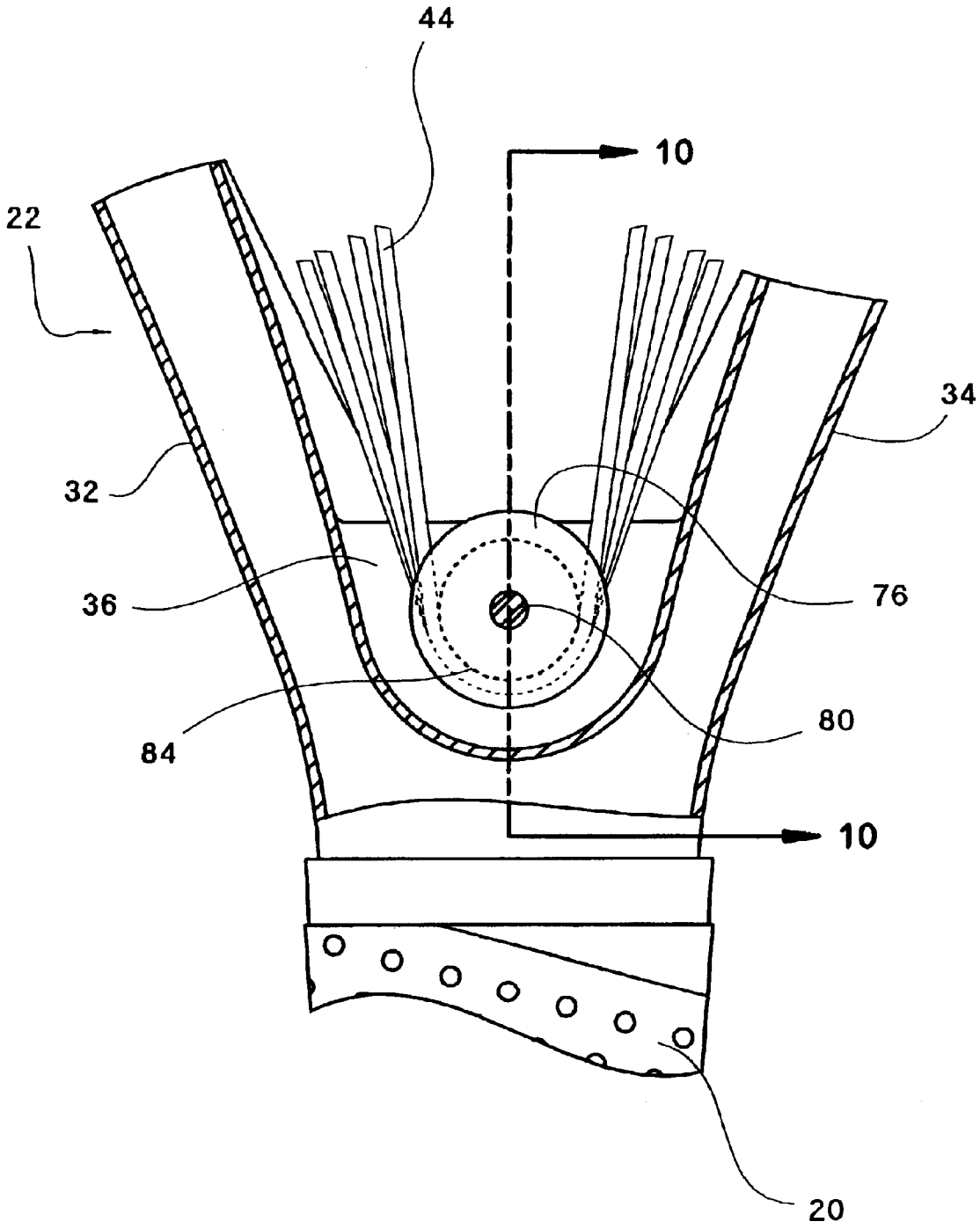
FIG. 9 is a longitudinal cross-sectional view of a throat portion of the racquet taken along a plane generally defined by the string bed of the racquet, in accordance with another alternative preferred embodiment of the present invention
Figure 10:
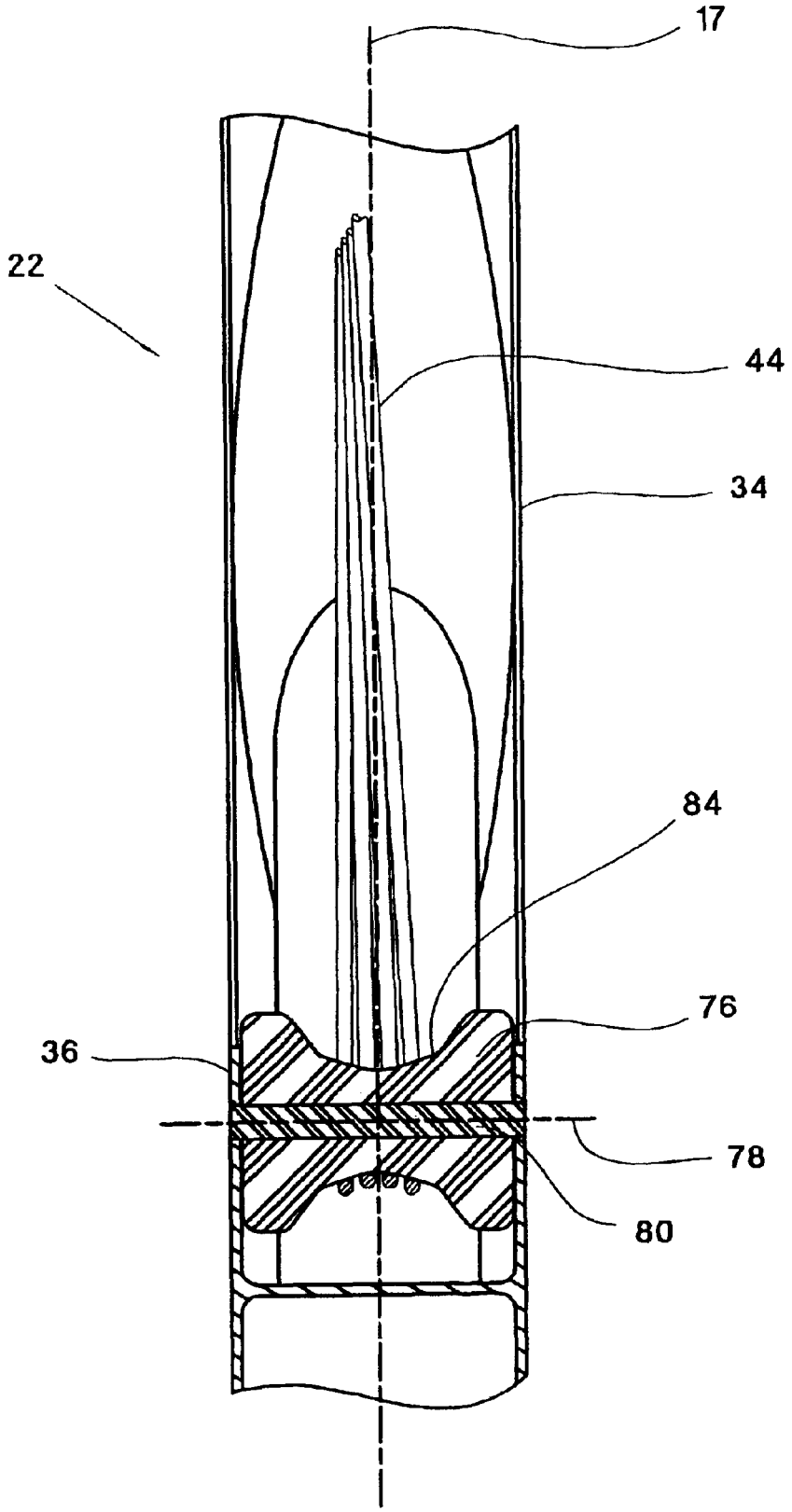
FIG. 10 is a longitudinal cross-sectional view of the throat portion taken along line 10—10 of FIG. 9.

Referring to FIGS. 9 and 10, in another alternative preferred embodiment, the peripheral main string segments 44 can be supported at the crotch region 36 of the throat portion 22 through a bearing in the form of a roller 76. The roller 76 is a generally cylindrical support member having a transverse axis 78 that is positioned generally perpendicular to the axis 17 of the racquet 10. The roller 76 is preferably positioned at the crotch region 36 of the throat portion 22. Alternatively, the roller 76 can be positioned within the handle portion 20. The roller 76 preferably includes at least one recessed groove 84 for receiving and guiding main string transition pieces 45. The roller position enables the peripheral main string segment length to be maximized and provides a path for the racquet string of one peripheral main string segment 44 to extend from the head portion 18 through the yoke 16 to the crotch region 36 around the roller 76 and back toward the yoke 16 and the head portion 18 to form another peripheral main string segment 44. The main string transition piece 45 extends about the roller 76 and connects two peripheral main string segments 44. The roller 76 preferably includes a pin 80, which is attached to the throat portion 22. The pin 80 can be configured to rotatably engage the roller 76, such that the roller 76 rotates with respect to the frame 12. In alternative preferred embodiments, the roller 76 can be attached to the throat portion through a non-rotatable connection, a press-fit connection, through the use of an adhesive, or other conventional fasteners, or combinations thereof. Alternatively, the bearing within the crotch region 36 of the throat portion 22 can be formed using: a rotatable roller, a non-rotatable roller, a rotatable pin, a non-rotatable pin and combinations thereof.

Figure 11:
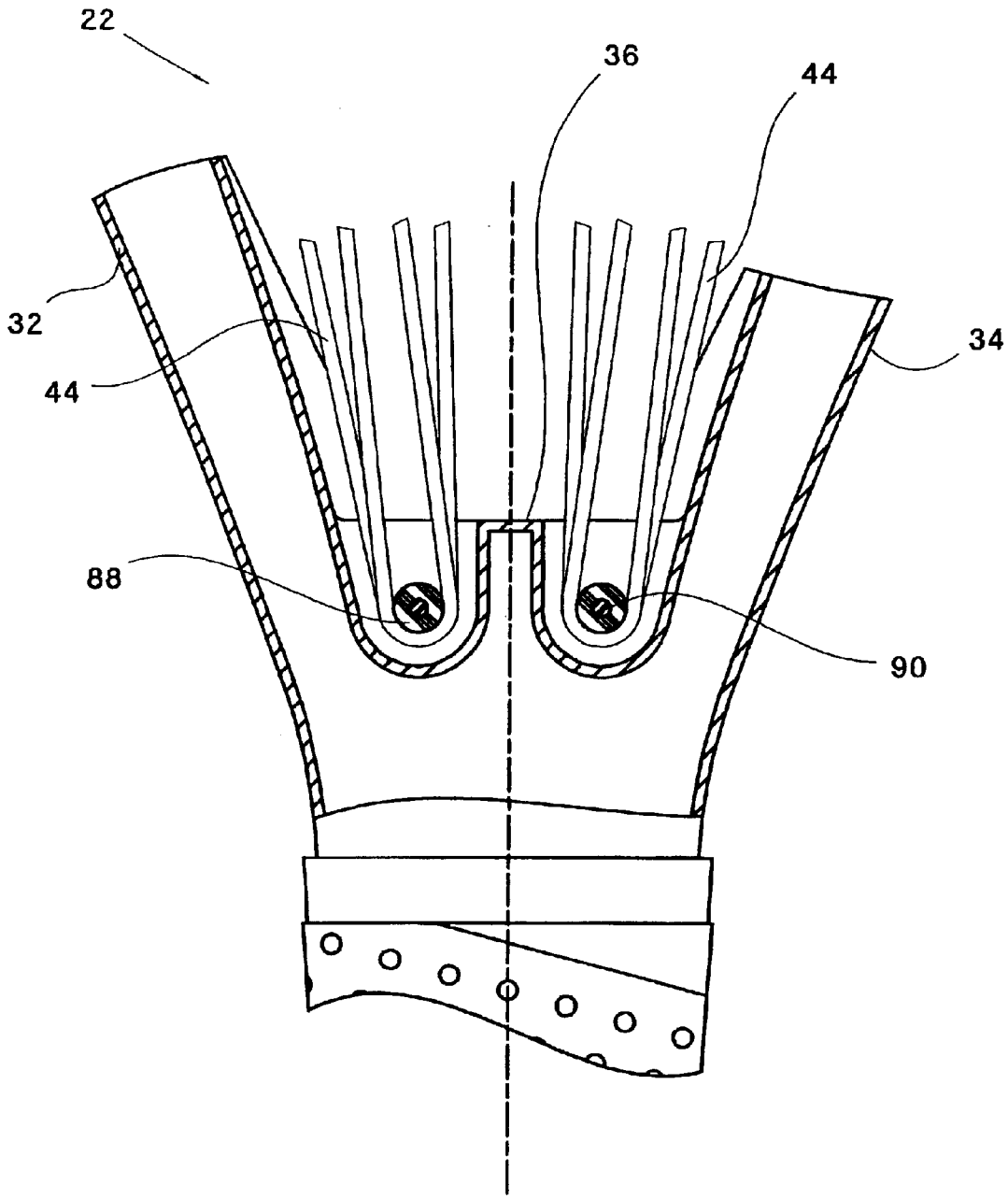
FIG. 11 is a longitudinal cross-sectional view of a throat portion of a racquet taken along a plane generally defined by the string bed of the racquet, in accordance with another alternative preferred embodiment of the present invention.

The roller 76 is made of a durable, wear resistant material, preferably, a nylon. Alternatively, the roller 76 can be formed of other materials, such as, for example, a urethane, a polyamide, a rubber, wood, aluminum, other metals, other polymeric materials and combinations thereof. The roller 76 provides a bearing surface for the main string transition pieces 45 which inhibits string wear and protects the racquet string from contact with sharp edges and rough surfaces. The roller 76 also provides a minimum bend radius thereby reducing the bending stresses applied to the one or more main string transition pieces 45 extending about the roller 76. In alternative preferred embodiments, the roller 76, or the first and second rollers 88 and 90, can be replaced with other forms of bearings, such as, for example, a pin, a cylindrical member, a semi-cylindrical member, an arcuate plate, Referring to FIG. 11, in another alternative preferred embodiment, the unitary roller 76 can replaced with first and second rollers 88 and 90 positioned in a spaced apart configuration about the crotch region 36 of the throat portion 22. Alternatively, the first and second rollers 88 and 90 can be attached to the first and second throat tubes 32 and 34, or to the handle portion 20. Each roller 88 and 90 is configured to support one or more peripheral main string segments 44 and one or more main string transition pieces 45. Preferably the first roller 88 supports the peripheral main string segments 44 on one side of the group of central main string segments 42 and the second roller 90 supports the peripheral main string segments 44 on the opposite side of the group of central main string segments 42. The first and second rollers 88 and 90 can be rotatably or non-rotatably coupled to the crotch region 36. In other embodiments, three or more bearings, such as, pins or rollers can be used.

Figure 12:
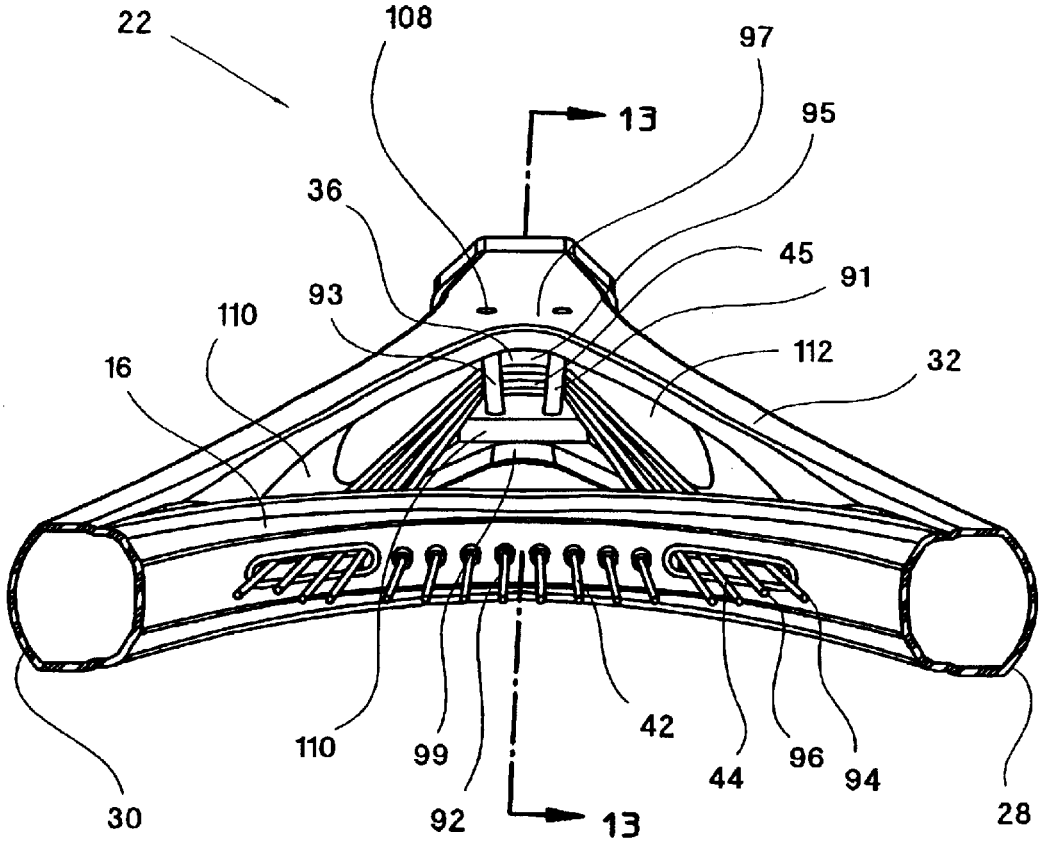
FIG. 12 is a front and top perspective sectional view of a yoke and a throat portion of a racquet in accordance with another alternative preferred embodiment of the present invention.
Figure 13:
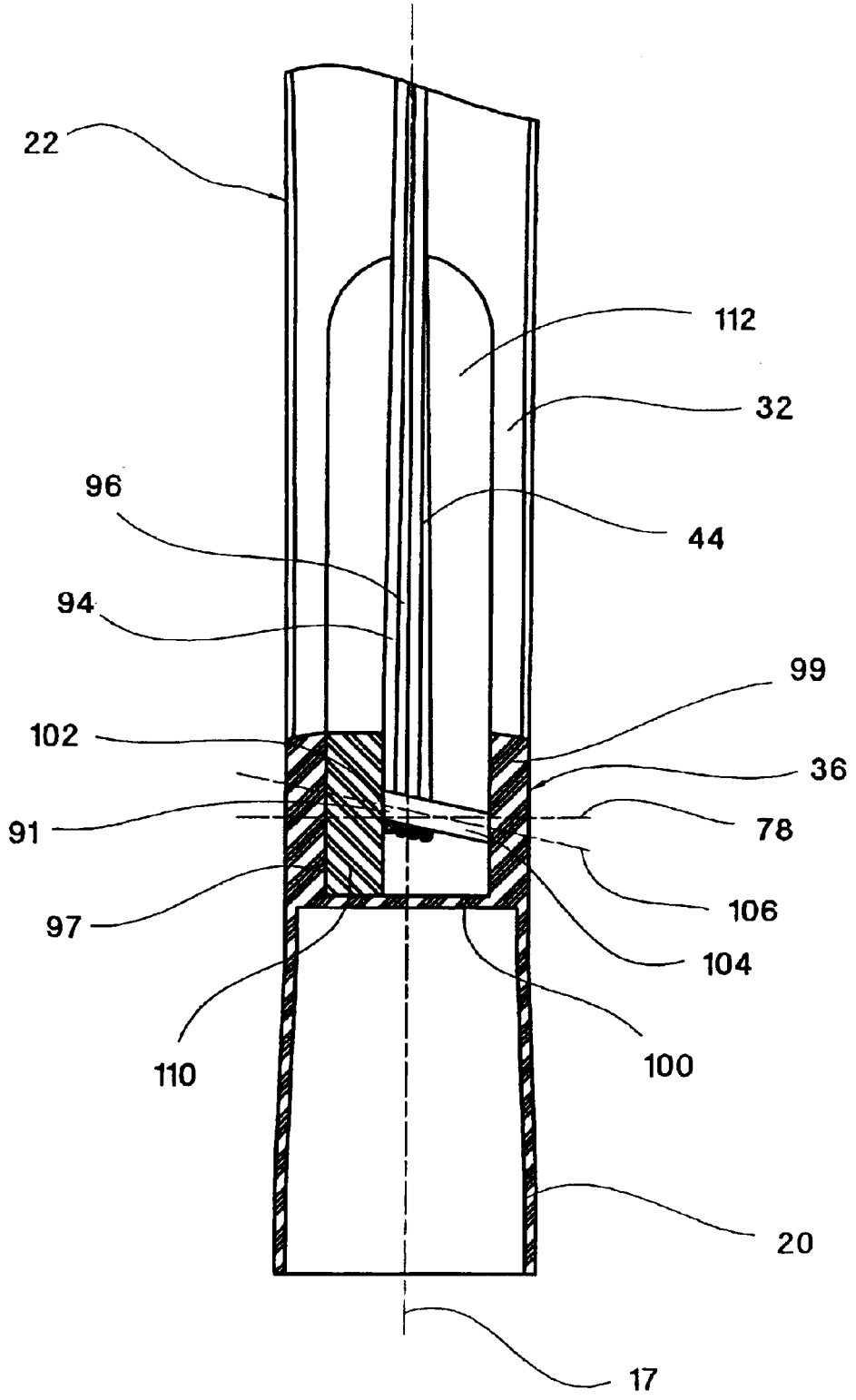
FIG. 13 is a longitudinal cross-sectional side view of the throat portion taken along line 13—13 of FIG. 12.

Referring to FIGS. 12 and 13, in another alternative preferred embodiment, the bearing can be specifically configured to align the main string transition pieces 45 generally side by side, and to inhibit the main string transition pieces 45 from laying on top of each other or shifting positions during use. The bearing of FIG. 12 includes first and second pins 91 and 93 positioned in, and coupled to, the crotch region 36 of the throat portion 22. The crotch region 36 includes a recessed cavity 95 for receiving the first and second pins 91 and 93, and for providing space for the routing of the racquet string about the pins 91 and 93 during stringing. In a particularly preferred embodiment, the cavity 95 is defined by first and second crotch side walls 97 and 99, and a curved lower wall 100. The first and second side walls 97 and 99 and lower wall 100 form at least a portion of a passage for the routing of the racquet string about the pins 91 and 93. Each of the first and second pins 91 and 93 have first and second ends 102 and 104.

The pins 91 and 93 are preferably angled with respect to each other and/or with respect to the racquet frame 12 and extend across the crotch region 36. In a particularly preferred embodiment, the first and second pins 91 and 93 are angled with respect to both of the longitudinal and transverse axes 17 and 78 of the frame 12. Referring to FIG. 13, a longitudinal axis 106 of the first pin 91 is illustrated. The longitudinal axis 106 is angled with respect to the longitudinal and transverse axes 17 and 78. The first pin 91 is also preferably angled with respect to a transverse plane, which is perpendicular to the longitudinal axis 17 and extends through the transverse axis 78.

Referring to FIGS. 12 and 13, the first ends 102 of the first and second pins 91 and 93 are spaced apart from each other by a first distance and the second ends 104 of the first and second pins 91 and 93 are spaced apart by a second distance, and the first distance is shorter than the second distance thereby sloping, or angling the pins 91 and 93 with respect to transverse and longitudinal axes 68 and 17. The first ends 102 of the first and second pins 91 and 93 are positioned closer to each other than the second ends 104 of the first and second pins 91 and 93 are to each other.

The pins 91 and 93 are preferably press-fit to the frame 12 through holes 108 formed into the first and second crotch side walls 97 and 99 of the crotch region 36 of the throat portion 22. In alternative preferred embodiments, the pins 91 and 93 can be attached to the crotch region 36 through other means, such as, for example, other press-fit connections, conventional fasteners, adhesives and combinations thereof. In another alternative preferred embodiment, the one or more pins 91 and 93, or similarly structured devices, can be integrally formed with the frame 12 of the racquet 10. The pins 91 and 93 are made of a durable, wear resistant material, preferably, a nylon. Alternatively, the pins 91 and 93 can be formed of other materials, such as, for example, a urethane, a polyamide, a rubber, wood, aluminum, other metals, other polymeric materials and combinations thereof.

The first and second pins 91 and 93 preferably further include at least one bushing 110 positioned at the first ends 102 adjacent to the first crotch side wall 97 of the crotch region 36. The bushing 110 serves as a spacer to optimize the position the main string transition pieces 45 relative to the side walls 97 and 99. The bushing 110 is preferably adhesively bonded to the crotch region 36. Alternatively, the bushing 110 can be connected by other means, such as, for example, conventional fasteners, press-fit connections, and integrally formed or molded with one or more of the pins or with the frame itself.

The angled positioning of the first and second pins 91 and 93 facilitates the alignment and positioning of the main string transition pieces 45. Preferably, the pins 91 and 93 enable the main string transition pieces 45 to each engage the pins 91 and 93, and align next to one or more adjacent transition pieces 45. The angled pins 91 and 93 also serve to inhibit the repositioning or overlapping of the transition pieces 45 during use.

The first and second throat tubes 32 and 34 each preferably include a shallow recess 112. The recess 112 increases the space available within the throat portion 22 between the throat tubes 32 and 34. The increased space facilitates the stringing of the peripheral main string segments 44 through the throat portion 22 and the crotch region 36. The recesses 112 also further space apart the throat tubes 32 and 34 from the peripheral main string segments 44 thereby eliminating undesirable contact between the throat tubes 32 and 34 and the peripheral main string segments 44.

In alternative preferred embodiments, each pin can include one or two separate bushings to facilitate alignment of the main string transition pieces. In another alternative preferred embodiment, the pin(s) can be integrally formed with one or more bushings, or to one or more stops, to facilitate alignment of the main string transition pieces. Alternatively, each pin can be curved so as to facilitate the alignment of the main string transition segments. In alternative preferred embodiments, the first and second pins 91 and 93 can be substituted with a one piece or multi-piece structure having first and second sides that are angled with respect to each other and/or the racquet frame, or otherwise curved, so as to provide similar alignment advantages as the first and second pins. In another alternative preferred embodiments, three or more pins can be used in place of the first and second pins.

The preferred embodiments of the present invention provide a racquet with main string segments 42 and 44 of more uniform length than many typical existing racquets. The main string segments 42 include at least one central-most main string segment 92 (see FIGS. 1, 4 and 6), wherein the central most main string segment 92 extends along, or is positioned adjacent to, the longitudinal axis 17. Preferably, the racquet 10 includes two central-most main string segments 92 spaced apart from each other and the longitudinal axis 17. The central-most main string segment(s) 92 represent the one or two main string segments that are aligned closest to the longitudinal axis 17 of the racquet 10. The central-most main string segment 92 has a first length preferably defined by its engagement locations with the frame 12. In particular, the first length is defined by the distance between a first end located where the central-most main string segments engages the upper region 26 of the head portion 18, and a second end located where the central-most main string segment 92 engages the yoke 16.

The peripheral main string segments 44 include at least one, and preferably two, outermost peripheral main string segments 94 (see FIGS. 1, 4 and 6). The outermost peripheral main string segment(s) 94 refers to the one or two peripheral main string segments 44 that is (are) closest to at least one of the first and second side regions 28 and 30 of the head portion 18. Preferably, the racquet 10 includes two outermost peripheral main string segments 94 positioned generally along the plane defined by the string bed. Each of the outermost peripheral main string segments is spaced apart from the longitudinal axis 17 in opposite directions, such that one of the outermost peripheral main string segments 94 is positioned adjacent to the first region 28 of the head portion 18 and the other outermost peripheral main string segment 94 is positioned adjacent to the second region 30 of the head portion 18. Each of the outermost peripheral main string segments 94 is the main string segment that is furthest from the longitudinal axis 17, generally along its length, than the remaining main string segments when viewed in a direction from, and generally perpendicular to, the axis 17.

The outermost peripheral main string segment(s) 94 has a second length defined by the outermost peripheral main string segment's locations of engagement with the frame 12. In particular, a first end of the outermost peripheral main string segment 94 is located where the outermost peripheral main string segment 94 engages the upper region 26 of the head portion. Alternatively, the first end of the outermost peripheral main string segment 94 can be positioned where the outermost peripheral main string segment engages one of the first and second side regions of the head portion 18. The second end of the outermost peripheral main string segment 94 is located where the outermost peripheral main string segment directly engages the first throat tube 32, the second throat tube 34, the crotch region 36 of the throat portion 22, or the handle 20.

The second length of each of the outermost peripheral main string segments 94 is at least 75 percent of the first length of the central most main string segment 92. In one particularly preferred embodiment, the second length is at least 80 percent of the first length. In other particularly preferred embodiments, the second length is at least 85 percent, at least 90 percent, and at least 95 percent the first length.

The peripheral main string segments further include a pair of second outermost main string segments 96. The second outermost main string segments 96 are spaced apart from each other and the longitudinal axis 17. Each of the second outermost main string segments is positioned adjacent to one of the outermost main string segments 94. Each of the second outermost peripheral string segments 96 is the second furthest main string segment from the longitudinal axis 17, generally along its length, when viewed in a direction from, and generally perpendicular to, the axis 17.

Each of the second outermost peripheral main string segments 96 have a third length, which can be determined in the same manner as the outermost peripheral main string segments 94. In a preferred embodiment, the third length of each of the second outermost peripheral main string segments 96 is at least 85 percent of the first length of the central-most main string segment 92. In other alternative preferred embodiments the third length can be at least 90 percent, at least 95 percent, or at least equivalent to, the first length.

Table 1 illustrates main string segment lengths and the various ratios of these lengths for three different types of existing racquets and for two racquets built in accordance with the preferred embodiment of FIG. 1. The three existing groups of racquets include:

(1) racquets having a traditional oval shaped head portion with no elongated main string segments;

(2) racquets having a head shape resembling a reversed, or inverted, egg shape, such as the Wilson® Sledge Hammer®; and (3) racquets having a head portion that is more rectangular/oval shaped racquet head portions, such as the Yonex® Ultimum RQ Ti 2000 racquet and the Yonex® MP 51I racquet.

Table 1 illustrates that the length of main string segments in existing racquets can vary significantly, particularly the lengths of the central-most main string segment and the outermost or second outermost peripheral main string segments. The variation between the lengths of the central-most main string segments and the outermost peripheral main string segments ranged from approximately 27% to 35%, and the variation in lengths between the central-most main string segments and the second outermost peripheral main string segments ranged from 17% to 24%. Further, in every case the peripheral main string segments were significantly shorter than the central-most main string segments. Shorter main string segments result in reduced power and reduced dwell time (or impact duration) upon impact with the ball.

Table 1 also illustrates that the racquets built in accordance with the preferred embodiment of FIG. 1 provide outer peripheral main string segments that are closer in length to the length of the central-most main string segments. Only one of the outermost peripheral main string segments was shorter (and only by approximately 4%) than the central-most main string segment. The remaining outermost peripheral main string segments had lengths greater than the central most main string segment, with the greatest variation in length being approximately 10%. The elongated outermost peripheral main string segments are generally consistent in length with the length of the central-most main string segment(s) and enable the racquet to produce an enlarged sweet spot and increase the dwell time with the ball during impact.

The extension of the peripheral main string segments 44 into the throat region 22 of the racquet 10 produces larger areas of increased COR response without negatively affecting the maneuverability of the racquet 10. As such, the present invention provides a racquet 10 with more consistent power and control. The string configuration of the present invention results in an increased dwell time, or period of contact with the ball and the string bed, thereby resulting in improved responsiveness and enabling the user impart more spin onto the ball, if desired. The present invention can be readily produced and strung without significantly increasing the complexity or cost of the racquet. Moreover, the present invention provides the above-mentioned performance characteristics without radically departing from the configuration of a traditional racquet.

TABLE 1

RACQUET MAIN STRING SEGMENT LENGTHS AND RATIOS

| Racquet Head Type | Supplier/Model | Head Size (Sq. Inches) | Length Of Central-Most Main String Segment (A) | Length of Outermost Peripheral Main String Segment (B) | Length of Second Outermost Peripheral Main String Segment (C) | Ratio Of Outermost Peripheral And Central-Most Main String Segments (B/A) | Ratio Of Second Outermost Peripheral And Central-Most Main String Segments (C/A) |
|---|---|---|---|---|---|---|---|
| Traditional Oval Shaped Head Portions | | 110 | 13.56 in | 9.03 in | 10.48 in | 66.59% | 77.29% |
| | | 95 | 12.61 in | 7.76 in | 9.58 in | 61.54% | 75.97% |
| | | 90 | 12.30 in | 7.93 in | 9.42 in | 64.47% | 76.58% |
| Generally Reversed Egg Shaped Head Portion | Wilson ® Sledge Hammer ® | 115 | 14.40 in | 10.26 in | 11.78 in | 71.25% | 81.80% |
| | | 110 | 13.69 in | 9.99 in | 11.34 in | 72.97% | 82.83% |
| | | 95 | 12.72 in | 8.77 in | 10.07 in | 68.95% | 79.16% |
| Generally Rectangular/ Oval Shaped Head Portion | Yonex ® Ultimum RQ Ti 2000 | 120 | 351.0 mm | 237.5 mm | 286.2 mm | 67.66% | 81.54% |
| | Yonex ® MP 5i | 110 | 352.6 mm | 237.5 mm | 285.6 mm | 67.36% | 81.00% |
| Racquet Produced in Accordance with the Preferred Embodiment of FIG. 1 | Wilson ® | | 14.44 in | 13.83 in | 15.26 in | 95.78% | 105.68% |
| | | | 14.40 in | 14.75 in | 15.96 in | 102.43% | 110.83% |

Figure 14:
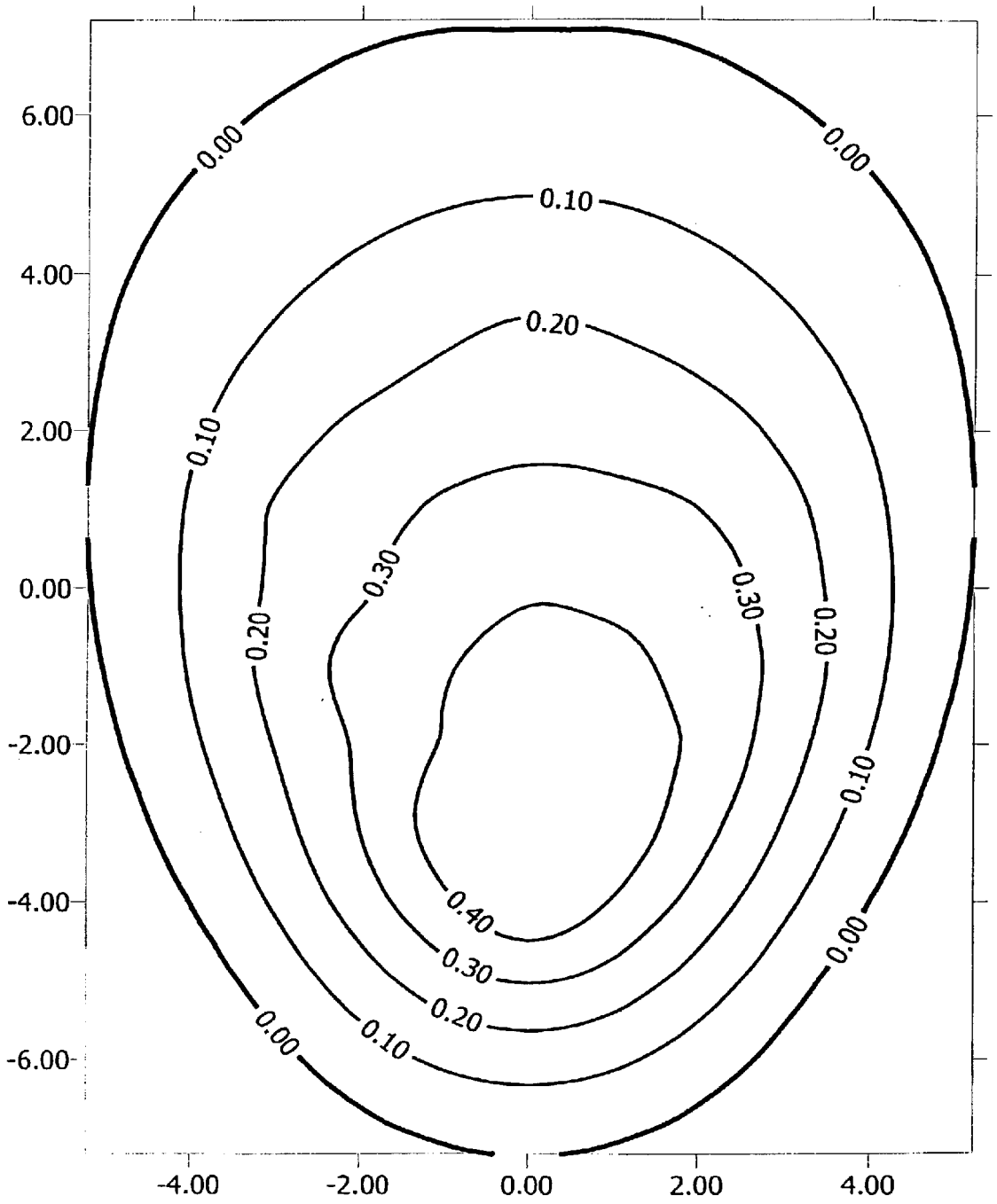
FIG. 14 is a two dimensional mapping of the coefficients of restitution on the string bed of a racquet built in accordance with a preferred embodiment of the present invention.
Figure 15:
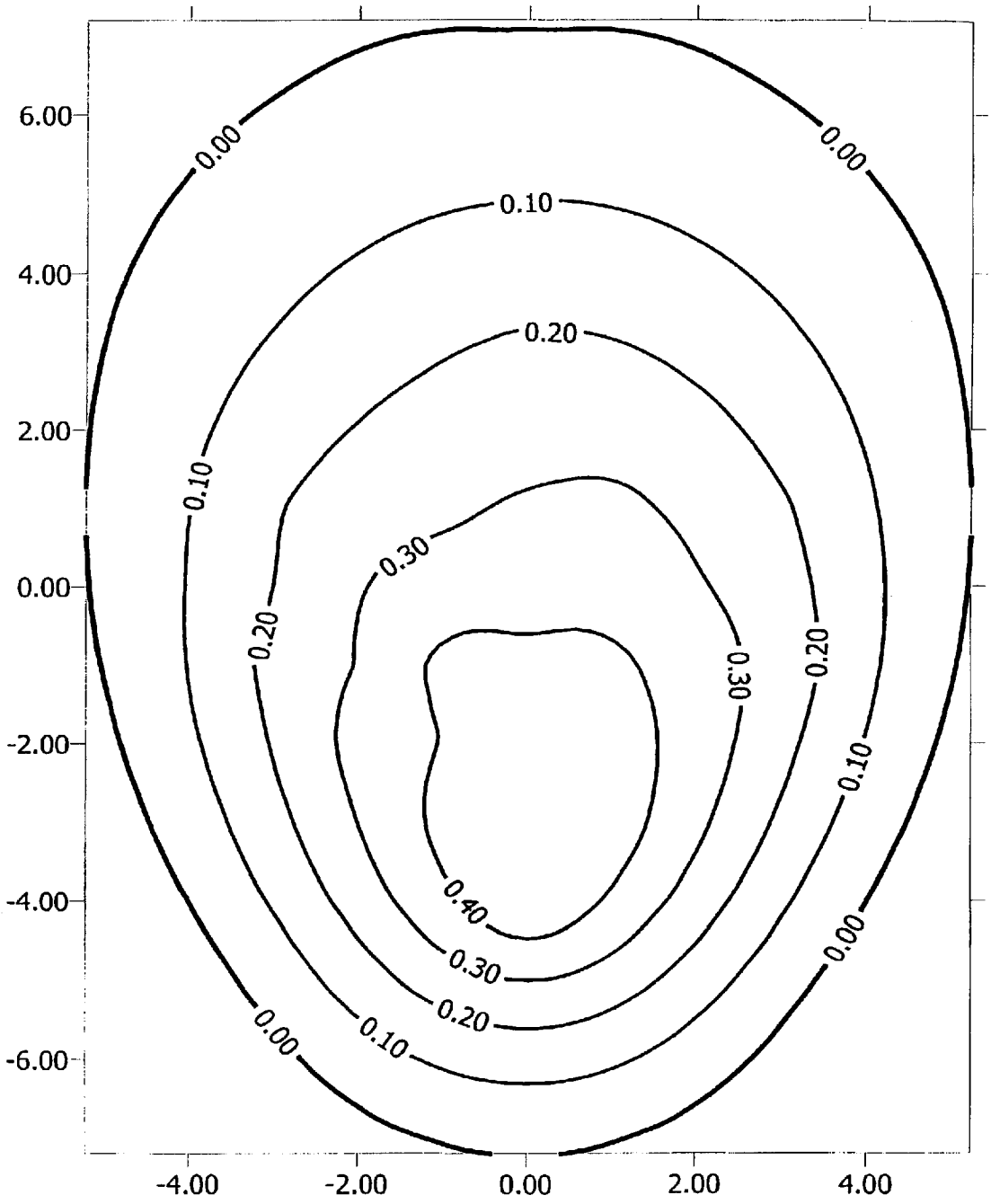
FIG. 15 is a two dimensional mapping of the coefficients of restitution on the string bed of a racquet having a similar frame shape as the racquet of FIG. 14, but without elongated peripheral main string segments.

Referring to FIGS. 14–16, mappings of the areas of various coefficient of restitution ("COR") values for a racquet of the present invention and for representative prior art racquets are illustrated. The COR is the ratio of the rebound velocity of a ball, such as, for example, a tennis ball, to the incoming velocity of the ball. The COR values of FIGS. 14–16 were measured by using an incoming velocity of 90 feet per second, +/−5 feet per second. Each mapping reflects the COR values resulting from the impacts of the ball with the string bed at numerous, distributed locations about the string bed. The mappings of FIGS. 14–16 were obtained from taking COR measurements at 36 different locations on the string bed of the racquet, wherein each location is impacted 5 times for a total of 180 data points per racquet. The racquet is supported in the test apparatus only at the handle. In particular, the test apparatus secures the proximal end of the handle (approximately the proximal 6 inches of the handle). The attachment of the test apparatus to the racquet restricts the proximal end of the handle from moving or twisting along the x, y or z axes. Each racquet of FIGS. 14–16 and Tables 2–4 possessed a string tension of 55 lbs tension, measured in a strung condition generally at the center of the string bed.

FIG. 14 illustrates the enlarged areas of COR for a racquet built in accordance with the preferred embodiment of FIG. 6 of the present invention (the racquet designated as "H1 ES 1"). The numerical values of the COR areas for the racquet mapped in FIG. 14 (the H1 ES 1 racquet), as well as two additional racquets, also built in accordance with the preferred embodiment of FIG. 6 (racquets "H1 ES 2" and "H1 ES 3"), are provided in Table 2. Table 2 further provides the average area for each COR value listed for the three racquets (H1 ES 1, H1 ES 2 and H1 ES 3). Each of the three racquets of Table 2 have a head size of 116 square inches and a swing weight of approximately 2538.6 oz*in$^2$. Swing weight is also known as the moment of inertia of the racquet about a swing axis positioned at the proximal end of the racquet 10. The swing axis extends perpendicular to the longitudinal axis 17 and to the plane defined by the string bed 14.

FIG. 15 illustrates the areas of COR for a racquet having the same frame as the racquet of FIG. 14, but without elongated peripheral main string segments (the racquet designated as "H1 Non-ES 1"). The numerical values of the COR areas for the racquet mapped in FIG. 15 (the H1 Non-ES 1 racquet), as well as two additional racquets, also built with the same frame as the racquets of FIG. 14 but without elongated peripheral main string segments (racquets "H1 Non-ES 2" and "H1 Non-ES 3"), are provided in Table 3. Table 3 further provides the average area for each COR value listed for the three racquets (H1 Non-ES 1, H1 Non-ES 2 and H1 Non-ES 3). Each of the three racquets of Table 3 also have a head size of 116 square inches and a swing weight of approximately 2562.1 oz*in$^2$.

FIG. 16 illustrates the areas of COR for a representative prior art racquet. A racquet having generally the same shape, approximately the same head size, and a similar swing weight as the racquet of FIG. 14 was selected as a representative prior art racquet. The representative prior art racquet, a Head® Model Ti S6 racquet, has generally the same shape as the racquet of FIG. 14, a head size of 116 square inches and a swing weight of 2490.1 oz*in$^2$. The numerical values of the COR areas for the racquet mapped in FIG. 16 (the prior art 1 racquet), as well as two additional racquets of the same make and model as the representative prior art racquet of FIG. 16 (prior art 2 and prior art 3 racquets), are provided in Table 4. Table 4 further provides the average area for each COR value listed for the three representative prior art racquets.

In FIGS. 14–16, the line labeled 0.45 represents the border of the area on the strings where the COR was 0.45 or greater. The line indicated as 0.40 represents the border of the area on the strings where the COR was 0.40 or greater. Similarly, the other lines in FIGS. 14–16 represent borders for the areas on the strings for various values of COR. The "sweet spot" of the racquet is generally defined as the area of the string bed having one of the three following COR values: 2.5 or greater, 3.0 or greater, or 3.5 or greater. The numbers on the horizontal and vertical axes of FIGS. 14–16 represent the distance from the center of the strung surface. For example, the center of the strung surface is indicated as 0.00. Two inches to the right of center of the strung surface is indicated as 2.00, 2 inches to the left of the center is indicated as −2.00, etc.

TABLE 2

Racquets Built In Accordance With The Preferred Embodiment of FIG. 6
RACQUETS OF THE PRESENT INVENTION

| | H1 ES (3) | H1 ES (1) | H1 ES (2) | H1 ES Avg. |
|---|---|---|---|---|
| 0.45 | 3.60 | 3.89 | 3.77 | 3.75 |
| 0.40 | 9.59 | 9.88 | 10.27 | 9.91 |
| 0.35 | 17.64 | 17.55 | 17.29 | 17.49 |
| 0.30 | 25.78 | 25.80 | 25.47 | 25.68 |
| 0.25 | 35.31 | 35.41 | 35.51 | 35.41 |
| 0.20 | 46.85 | 46.99 | 46.42 | 46.75 |
| 0.15 | 59.62 | 59.40 | 58.72 | 59.24 |
| 0.10 | 74.05 | 74.05 | 73.43 | 73.84 |

TABLE 3

Racquets Having The Same Frame As The Racquets Of Table 2, But Without Elongated Peripheral Main String Segments.
RACQUETS WITHOUT ELONGATED PERIPHERAL MAIN STRINGS

| | H1 NON-ES 2 | H1 NON-ES 1 | H1 Non-ES 3 | H1 NON-ES AVERAGE |
|---|---|---|---|---|
| 0.45 | 2.23 | 3.19 | 2.61 | 2.67 |
| 0.40 | 8.87 | 8.91 | 8.99 | 8.93 |
| 0.35 | 15.55 | 15.78 | 16.34 | 15.89 |
| 0.30 | 23.26 | 24.04 | 24.16 | 23.82 |
| 0.25 | 33.01 | 33.80 | 33.71 | 33.51 |
| 0.20 | 45.02 | 45.39 | 45.20 | 45.20 |
| 0.15 | 57.75 | 57.98 | 57.69 | 57.81 |
| 0.10 | 72.72 | 72.85 | 72.55 | 72.71 |

TABLE 4

Representative Prior Art Racquets
REPRESENTATIVE PRIOR ART RACQUETS

| | Prior Art Racquet 2 | Prior Art Racquet 3 | Prior Art Racquet 1 | Prior Art Racquet Avg. |
|---|---|---|---|---|
| 0.45 | 0.56 | 1.37 | 0.00 | 0.64 |
| 0.40 | 5.77 | 6.71 | 7.51 | 6.66 |
| 0.35 | 13.40 | 13.45 | 14.30 | 13.71 |
| 0.30 | 21.12 | 21.32 | 21.48 | 21.31 |
| 0.25 | 30.78 | 31.45 | 30.84 | 31.02 |
| 0.20 | 40.96 | 44.06 | 43.06 | 42.70 |
| 0.15 | 53.00 | 57.43 | 56.32 | 55.58 |
| 0.10 | 67.81 | 72.57 | 71.60 | 70.66 |

A comparison of FIGS. 14–16 and the data of Tables 2–4 indicates that the racquet made in accordance with the invention has a greater area within each of the border lines for various CORs. Tables 5 and 6 further illustrate the enlarged areas of COR for the racquet of the present invention (the racquet of FIG. 14 and Table 2) compared to the racquets of FIG. 15 and Table 3, and the representative prior art racquets of FIG. 16 and Table 4. In particular, Table 5 lists the average areas for various COR values from Table 2 for the racquets of the present invention, the average areas for various COR values for the racquets of Table 3, and percentage increase in these COR values provided by the present invention over racquets without elongated peripheral main string segments. Also, Table 6 lists the average areas for various COR values from Table 2 for the racquets of the present invention, the average areas for various COR values for the prior art racquets of Table 4, and percentage increase in these COR values provided by the present invention.

TABLE 5

COMPARISON OF COR AREAS FOR RACQUETS OF PRESENT INVENTION WITH RACQUETS OF TABLE 3

| COR | H1 ES AVG. | H1 NON-ES AVG. | % DIFFERENCE |
|---|---|---|---|
| 0.45 | 3.75 | 2.67 | 40.26% |
| 0.40 | 9.91 | 8.93 | 11.01% |
| 0.35 | 17.49 | 15.89 | 10.08% |
| 0.30 | 25.68 | 23.82 | 7.83% |
| 0.25 | 35.41 | 33.51 | 5.67% |
| 0.20 | 46.75 | 45.20 | 3.43% |

TABLE 6

COMPARISON OF COR AREAS FOR RACQUETS OF PRESENT INVENTION WITH REPRESENTATIVE PRIOR ART RACQUETS OF TABLE 4

| COR | H1 ES AVG. | PRIOR ART RACQ. AVG. | % DIFFERENCE |
|---|---|---|---|
| 0.45 | 3.75 | 0.64 | 485.94% |
| 0.40 | 9.91 | 6.66 | 48.80% |
| 0.35 | 17.49 | 13.71 | 27.57% |
| 0.30 | 25.68 | 21.31 | 20.51% |
| 0.25 | 35.41 | 31.02 | 14.15% |
| 0.20 | 46.75 | 42.7 | 9.48% |

As provided in Tables 5 and 6, the racquet of the present invention increases the area for the COR value of 0.45 by 485.94 percent over the representative prior art racquets of Table 4, and by 40.26 percent over the racquets without elongated peripheral main string segments of Table 3. At the COR value of 0.40, the area increases by 48.8 percent over the representative prior art racquets of Table 4, and by 11.01 percent over the racquets without elongated peripheral main string segments of Table 3. Similarly, at the COR value of 0.35, the area increases by 27.57 percent over the representative prior art racquets of Table 4, and by 10.08 percent over the racquets without elongated peripheral main string segments of Table 3. Further, at the COR value of 0.30, the area increases by 20.51 percent over the representative prior art racquets of Table 4, and by 7.83 percent over the racquets without elongated peripheral main string segments of Table 3. Finally, at the COR value of 0.25, the area increases by 14.15 percent over the representative prior art racquets of Table 4, and by 5.67 percent over the racquets without elongated peripheral main string segments of Table 3.

As demonstrated by FIGS. 14–16 and Tables 2–6, the present invention results in enlarged areas for every COR value measured, and a significantly larger sweet spot. In addition, a review of FIGS. 14–16 also indicates that the present invention generally elongates and widens the areas of the many of the measured COR values.

While the preferred embodiments of the present invention have been described and illustrated, numerous departures therefrom can be contemplated by persons skilled in the art. Therefore, the present invention is not limited to the forgoing description but only by the scope and spirit of the appended claims.

What is claimed is:

1. A sports racquet comprising:

a frame including a head portion, a handle portion, and a throat portion positioned between the head and handle portions, the head portion including an upper region, and first and second side regions;

a yoke coupled to, and extending between, the first and second side regions, the head portion and the yoke defining a string bed area; and a string bed formed of a plurality of cross string segments and a plurality of main string segments, the main string segments including at least one central main string segment and at least two peripheral main string segments, each central main string segment having first and second ends wherein the first end engages the upper region of the head portion and the second end engages the yoke without engaging either the throat portion or the handle portion, each of the peripheral main string segments extending, across the string bed area, through the yoke, and into the throat portion, each peripheral main string segment coupled at a distal end to the upper region of the head portion and at a proximal end to at least one of the throat portion and the handle portion, the throat portion including first and second tubular members, and a plurality of string holes for engaging the proximal ends of the peripheral main string segments being formed into each of the first and second tubular members.

2. The sports racquet of claim 1, wherein the string holes of the first and second tubular members of the throat portion are substantially coplanar with the string bed.

3. The sports racquet of claim 1, wherein each of the first and second tubular members includes at least two pairs of strings holes, and wherein the two pairs of string holes are generally symmetrically spaced from each other about a plane defined by the string bed.

4. A sports racquet comprising:

a frame including a head portion, a handle portion, and a throat portion positioned between the head and handle portions, the head portion including an upper region, and first and second side regions;

a yoke coupled to, and extending between, the first and second side regions, the head portion and the yoke defining a string bed area;

a string bed formed of a plurality of cross string segments and a plurality of main string segments, the main string segments including at least one central main string segment and at least two peripheral main string segments, each central main string segment having first and second ends wherein the first end engages the upper region of the head portion and the second end engages the yoke without engaging either the throat portion or the handle portion, each of the peripheral main string segments extending, across the string bed area, through the yoke, and into the throat portion, each peripheral main string segment coupled at a distal end to the upper region of the head portion and at a proximal end to at least one of the throat portion and the handle portion; and a bearing coupled to one of the throat portion and the handle portion, the bearing supporting the at least two peripheral main string segments.

5. The sports racquet of claim 4, wherein the bearing is selected from the group consisting of a roller, a pin, a cylindrical member, a semi-cylindrical member, an arcuate plate, and tubular housing.

6. The sports racquet of claim 4, wherein the throat portion includes first and second tubular members, wherein the first and second tubular members extend toward each other to form a crotch, and wherein the bearing is connected to the throat portion at the crotch.

7. The sports racquet of claim 4, wherein the bearing is connected to a distal region of the handle portion.

8. The sports racquet of claim 4, wherein the bearing is two spaced apart pins or rollers, and wherein each of the pins or rollers is configured for supporting at least one peripheral main string segment.

9. The sports racquet of claim 8, wherein the two spaced apart pins are angled with respect to a plane generally defined by the string bed.

10. A sports racquet comprising:

a frame including a head portion, a handle portion, and a throat portion positioned between the head and handle portions, the head portion including an upper region, and first and second side regions;

a yoke coupled to, and extending between, the first and second side regions, the head portion and the yoke defining a string bed area; and a string bed formed of a plurality of cross string segments and a plurality of main string segments, the main string segments including at least one central main string segment and at least two peripheral main string segments, each central main string segment having first and second ends wherein the first end engages the upper region of the head portion and the second end engages the yoke without engaging either the throat portion or the handle portion, each of the peripheral main string segments extending, across the string bed area, through the yoke, and into the throat portion, each peripheral main string segment coupled at a distal end to the upper region of the head portion and at a proximal end to at least one of the throat portion and the handle portion, each of the peripheral main string segments including a string bed piece and a throat region piece, and the throat region piece being generally collinear with the string bed piece.

11. The sports racquet of claim 10, wherein the yoke is integrally formed with the head portion.

12. The sports racquet of claim 10, wherein the head portion is separated from at least one of the throat portion and the handle portion by an elastomer.

13. The sports racquet of claim 10, wherein the at least one central main string segment is at least two central main string segments, and where the at least two peripheral main string segments is at least four peripheral main string segments.

14. The sports racquet of claim 10, wherein the at least one central main string segment total eight central main string segments and the at least two peripheral main string segments total eight peripheral main string segments.

15. A sports racquet configured to support a string bed formed by a plurality of transversely extending cross string segments and a plurality of longitudinally extending central main string segments and a plurality of longitudinally extending peripheral main string segments, wherein each of the central and peripheral main string segments have a distal end and a proximal end, the sports racquet comprising:

a frame including a head portion, a handle portion, and a throat portion positioned between the head and handle portions, the head portion including an upper region, and first and second side regions;

a yoke coupled to, and extending between, the first and second side regions, the head portion and the yoke defining a string bed area, the yoke including a central section and first and second side sections, the central section being configured for engaging the proximal end of at least one central main string segment, and the first and second side sections configured to allow for at least one peripheral main string segment to extend through the yoke; and at least one of the throat portion and the handle portion including at least one peripheral main string support mechanism configured to engage the proximal end of the at least one peripheral main string segments, the throat portion including first and second tubular members, and the peripheral main string support mechanism being a plurality of string holes formed into the first and second tubular members throat portion.

16. The sports racquet of claim 15, wherein the string holes of the first and second tubular members of the throat portion are aligned to be substantially coplanar with the string bed.

17. The sports racquet of claim 15, wherein the plurality of string holes includes at least two pairs of strings holes in each of the first and second tubular members includes, and wherein the two pairs of string holes are generally symmetrically spaced from each other about a longitudinally extending plane that is generally centrally positioned along the frame.

18. A sports racquet configured to support a string bed formed by a plurality of transversely extending cross string segments and a plurality of longitudinally extending central main string segments and a plurality of longitudinally extending peripheral main string segments, wherein each of the central and peripheral main string segments have a distal end and a proximal end, the sports racquet comprising:

a frame including a head portion, a handle portion, and a throat portion positioned between the head and handle portions, the head portion including an upper region, and first and second side regions;

a yoke coupled to, and extending between, the first and second side regions, the head portion and the yoke defining a string bed area, the yoke including a central section and first and second side sections, the central section being configured for engaging the proximal end of at least one central main string segment, and the first and second side sections configured to allow for at least one peripheral main string segment to extend through the yoke; and at least one of the throat portion and the handle portion including at least one peripheral main string support mechanism configured to engage the proximal end of the at least one peripheral main string segments, the peripheral main string support mechanism being a bearing coupled to one of the throat portion and the handle portion, and the bearing being configured to support at least two peripheral main string segments.

19. The sports racquet of claim 18, wherein the bearing is selected from the group consisting of a roller, a pin, a cylindrical member, a semi-cylindrical member, an arcuate plate, and generally U-shaped tubular housing.

20. The sports racquet of claim 19, wherein the throat portion includes first and second tubular members, wherein the first and second tubular members extend toward each other to form a crotch, and wherein the bearing is connected to the throat portion at the crotch.

21. The sports racquet of claim 18, wherein the bearing is connected to a distal region of the handle portion.

22. A sports racquet comprising:

a frame including a head portion, a handle portion, and a throat portion positioned between the head and handle portions; and a string bed coupled to the frame, the string bed formed of a plurality of cross string segments and a plurality of main string segments, the main string segments including at least two central main string segments and at least two peripheral main string segments, the length of each of the peripheral main string segments being greater than the length of each of the central main string segments, the throat portion including first and second tubular members, each of the peripheral main string segments including a proximal end, and a plurality of string holes for engaging the proximal ends of the peripheral main string segments being formed into each of the first and second tubular members.

23. The sports racquet of claim 22, wherein the string holes of the first and second tubular members of the throat portion are substantially coplanar with the string bed.

24. The sports racquet of claim 22, wherein each of the first and second tubular members includes at least two pairs of strings holes, and wherein the two pairs of string holes are generally symmetrically spaced from each other about a plane defined by the string bed.

25. A sports racquet comprising:

a frame including a head portion, a handle portion, and a throat portion positioned between the head and handle portions;

a string bed coupled to the frame, the string bed formed of a plurality of cross string segments and a plurality of main string segments, the main string segments including at least two central main string segments and at least two peripheral main string segments, the length of each of the peripheral main string segments being greater than the length of each of the central main string segments; and a bearing coupled to one of the throat portion and the handle portion, the bearing supporting the at least two peripheral main string segments.

26. The sports racquet of claim 25, wherein the bearing is selected from the group consisting of a roller, a pin, a cylindrical member, a semi-cylindrical member, an arcuate plate, and a tubular housing.

27. The sports racquet of claim 25, wherein the throat portion includes first and second tubular members, wherein the first and second tubular members extend toward each other to form a crotch, and wherein the bearing is connected to the throat portion at the crotch.

28. The sports racquet of claim 25, wherein the bearing is connected to a distal region of the handle portion.

29. The sports racquet of claim 25, wherein the bearing is two spaced apart pins or rollers, and wherein each of the pins or rollers is configured for supporting at least one peripheral main string segment.

30. The sports racquet of claim 29, wherein the two spaced apart pins are angled with respect to a plane generally defined by the string bed.

31. A sports racquet comprising:

a frame including a head portion, a handle portion, and a throat portion positioned between the head and handle portions; and a string bed coupled to the frame, the string bed formed of a plurality of cross string segments and a plurality of main string segments, the main string segments including at least two central main string segments and at least two peripheral main string segments, the length of each of the peripheral main string segments being greater than the length of each of the central main string segments, each of the peripheral main string segments including a string bed piece and a throat region piece, and the throat region piece being generally collinear with the string bed piece.

32. The sports racquet of claim 31, wherein the yoke is integrally formed with the head portion.

33. The sports racquet of claim 31, wherein the head portion is separated from at least one of the throat portion and the handle portion by an elastomer.

34. The sports racquet of claim 31, wherein the at least one central main string segment is at least two central main string segments, and where the at least two peripheral main string segments is at least four peripheral main string segments.

35. The sports racquet of claim 31, wherein the at least one central main string segment total eight central main string segments and the at least two peripheral main string segments total eight peripheral main string segments.

36. A sports racquet comprising:

a frame extending along a longitudinal axis, the frame including a head portion, a handle portion, and a throat portion positioned between the head and handle portions, the head portion including first and second side regions;

a yoke coupled to, and extending between, the first and second side regions;

at least two central main string segments including at least one central-most main string segment having a first length, the central-most main string segment being positioned at, or adjacent to, the longitudinal axis; and at least two peripheral main string segments including at least one outermost peripheral main string segment, the outermost peripheral main string segment having a second length, the outermost peripheral main string segment being spaced apart from the longitudinal axis and being positioned adjacent to one of the first and second side regions of the head portion, the second length being at least 75 percent of the first length.

37. The sports racquet of claim 36, wherein the second length is at least 80 percent of the first length.

38. The sports racquet of claim 36, wherein the second length is at least 85 percent of the first length.

39. The sports racquet of claim 36, wherein the second length is at least at least 90 percent of the first length.

40. The sports racquet of claim 36 wherein the at least one outermost peripheral main string segment consists of first and second outermost peripheral main string segments, wherein the first outermost peripheral main string segment is spaced apart from the longitudinal axis in a first direction and is positioned adjacent to the first side region, wherein the second outermost peripheral main string segment is spaced apart from the longitudinal axis in a second direction and is positioned adjacent to the second side region, and wherein the first direction is opposite the second direction.

41. The sports racquet of claim 40 wherein the peripheral main string segments include first and second, second outermost peripheral main string segments, wherein the first and second, second outermost peripheral main string segments are positioned adjacent to the first and second outermost peripheral main string segments, respectively, wherein each of the second outermost peripheral main string segments has a third length, and wherein the third length is at least 85 percent of the first length.

42. The sports racquet of claim 36 wherein the at least one central-most peripheral main string segment consists of spaced apart first and second central-most peripheral main string segments.

43. The sports racquet of claim 36 wherein the central and peripheral main string segments are generally parallel to the longitudinal axis as they extend along at least a portion of the length of the racquet.

44. The sports racquet of claim 36 wherein the central and peripheral main string segments are generally flared with respect to the longitudinal axis as they extend along at least a portion of the length of the racquet.

45. The sports racquet of claim 44, wherein the third length is at least 90 percent of the first length.

46. The sports racquet of claim 44, wherein the third length is at least 95 percent of the first length.

47. The sports racquet of claim 44, wherein the third length is at least equal to the first length.

* * * * *